US008968013B2

(12) United States Patent
Tochi et al.

(10) Patent No.: US 8,968,013 B2
(45) Date of Patent: Mar. 3, 2015

(54) MODULAR JACK

(71) Applicant: J.S.T. Mfg. Co., Ltd., Osaka (JP)

(72) Inventors: Akihiro Tochi, Yokohama (JP); Masaki Tsujimoto, Yokohama (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 74 days.

(21) Appl. No.: 13/892,477

(22) Filed: May 13, 2013

(65) Prior Publication Data

US 2014/0080333 A1 Mar. 20, 2014

(30) Foreign Application Priority Data

Sep. 14, 2012 (JP) ..... 2012-203481

(51) Int. Cl.
*H01R 24/64* (2011.01)
*H01R 13/50* (2006.01)
*H01R 13/453* (2006.01)

(52) U.S. Cl.
CPC ..... *H01R 13/501* (2013.01); *H01R 24/64* (2013.01); *H01R 13/453* (2013.01); *H01R 2201/06* (2013.01)
USPC ..... 439/131

(58) Field of Classification Search
USPC ..... 439/131, 144, 142, 638, 266, 676, 737, 439/344; 361/737
See application file for complete search history.

(56) References Cited

U.S. PATENT DOCUMENTS 5,147,213 A * 9/1992 Funk et al. ..... 439/266
5,385,479 A * 1/1995 Okada ..... 439/144
5,632,656 A * 5/1997 Lo ..... 439/676
5,773,332 A * 6/1998 Glad ..... 439/344
5,807,127 A * 9/1998 Ohshima ..... 439/266
6,113,432 A * 9/2000 Liao ..... 439/638
6,115,256 A * 9/2000 Centofante ..... 361/737
6,354,883 B2 * 3/2002 Jaing ..... 439/676
6,561,824 B1 * 5/2003 Beckham et al. ..... 439/131
6,966,798 B1 * 11/2005 Wu ..... 439/677
7,168,972 B1 * 1/2007 Autry et al. ..... 439/344
8,079,864 B2 * 12/2011 Lin et al. ..... 439/344
8,435,054 B2 * 5/2013 Liu ..... 439/142
2002/0146114 A1 * 10/2002 Kameya et al. ..... 379/433.05
2010/0248554 A1 * 9/2010 Hung et al. ..... 439/676
2014/0080333 A1 * 3/2014 Tochi et al. ..... 439/131

FOREIGN PATENT DOCUMENTS

JP 2000-92159 3/2000

* cited by examiner

*Primary Examiner* — Alexander Gilman

(74) *Attorney, Agent, or Firm* — Kratz, Quintos & Hanson, LLP

(57) ABSTRACT

A modular jack is composed of: a base connector installed on a printed circuit board, and a socket connector with a parallel crank mechanism at an extremity thereof, the parallel crank mechanism being slidably connected to the base connector and switching an upper housing between a raised state and a lowered state. When the upper housing is laid toward the front side of the socket connector, the socket connector can be housed inside the casing and both faces of the upper housing, the socket housing, and the base housing are made in a flat plate-like shape. This contributes to height reduction in the modular jack. The socket connector is configured such that, when the upper housing is pulled out from a side face of the casing and raised outside the casing, a plug can be electrically connected to the socket connector.

10 Claims, 26 Drawing Sheets

MODULAR JACK

This application is based on and claims the benefit of priority from Japanese Patent Application No. 2012-203481, filed on 14 Sep. 2012, the content of which is incorporated herein by reference.

BACKGROUND OF THE INVENTION

1. Field of the Invention

The present invention relates to a modular jack. More specifically, the present invention relates to a structure of a modular jack to which a modular plug for a LAN (Local Area Network) is connected, the modular jack being compactly installed in an electronic device such as a notebook PC, enabling a height reduction in the electronic device.

2. Related Art

An electronic device such as a notebook PC is provided with a modular jack for LAN connections on a side face or a rear face thereof. As a modular plug for a LAN, an RJ45 plug with 8 pin contacts is widely used. Many electronic devices such as notebook PCs therefore employ an RJ45 jack as a modular jack for a LAN.

Recently, the modular jack as described above is mounted on a printed circuit board and installed in an electronic device such as a notebook PC. However, the modular jack according to conventional techniques is has a large thickness and has a disadvantage in that it increases the size of the notebook PC in which the modular jack is installed.

In order to solve the abovementioned disadvantage, a modular jack is disclosed in Japanese Unexamined Patent Application Publication No. 2000-92159, for example, (hereinafter referred to as Patent Document 1). Patent Document 1 discloses a modular jack that can be electrically connected to a plug inserted into an insertion opening provided on a first end thereof, the modular jack comprising: a cuboidal housing with the insertion opening for the plug and a plug receiving chamber; and a cover housing. The cover housing can extend a side face of the housing adjacent to the insertion opening and extend the insertion opening, allowing insertion of the plug into the plug receiving chamber.

In other words, in the modular jack according to Patent Document 1, in a state before insertion of the plug into the jack, the side face of the cover housing overlaps the side face of the housing to a predetermined extent, and the height (h) of the jack is smaller than the height (H) of the jack after the insertion of the plug.

However, the modular jack according to Patent Document 1 includes a mechanism to pivotally support both side faces adjacent to a wall of the plug receiving chamber on the opposite side to the insertion opening such that the cover housing is rotatable, as a structure for extending the side face of the housing adjacent to the insertion opening and extending the insertion opening for the plug. Due to the thickness of the plug receiving chamber and the housing composing the plug receiving chamber with such a mechanism, the height (h) of the modular jack according to Patent Document 1 becomes greater than a prescribed height (Hp) of a plug corresponding to the RJ45 plug.

There is a demand for modular jacks for a LAN, such as the RJ45 jack, to be of lower height. This is because configuring the height of a modular jack to be less than the prescribed height (Hp) of the RJ45 plug enables reduction in the height of an electronic device such as a notebook PC in which the modular jack is installed.

SUMMARY OF THE INVENTION

The present invention has been made in view of the abovementioned problem and aims at providing a modular jack of a reduced height to be installed in an electronic device such as a notebook PC, allowing reduction in size of the electronic device.

An embodiment of the present invention is a modular jack to which a modular plug with a latching tab is electrically connected, the modular jack comprising a socket connector including:

a base connector provided inside a casing with an opening on a side face, an upper housing that can interlock with the latching tab, and a parallel crank mechanism that can switch the upper housing between a lowered state and a raised state, the socket connector being slidably connected to the base connector;

wherein in the lowered state of the upper housing, a front face of the upper housing shuts the opening and the socket connector can be housed inside the casing, and in the raised state in which the upper housing is pulled out from the opening and raised outside of the casing, the modular plug can interlock with the upper housing via the latching tab and electrically connect to the base connector.

The modular jack according to the embodiment of the present invention further comprises a fixing member for installing the base connector to a printed circuit board inside the casing.

In the modular jack according to the embodiment of the present invention, the fixing member is a metallic tab provided on a side wall of the base connector.

In the modular jack according to the embodiment of the present invention, the side wall of the base connector with the metallic tab is held along an edge portion of the printed circuit board.

In a more detailed first embodiment of the modular jack according to the embodiment of the present invention, the base connector includes:

a plate-like base housing provided with a first contact array base positioned on a rear side with respect to the opening of the casing, and a pair of opposing guide arms extending from the first contact array base toward the opening; and a first contact formed as a plurality of flat springs, an extremity portion thereof protruding from the first contact array base between the pair of guide arms, a middle portion thereof being fixed to the first contact array base, and a base end portion thereof protruding to a side opposite to the guide arms and being joined to the printed circuit board; and the socket connector includes:

a plate-like socket housing provided with a second contact array base that is positioned at a base end portion of the socket connector and engages with the first contact array base so as to overlap the first contact array base, and a base portion that is disposed at an extremity portion of the socket connector, both side faces thereof being guided to an inner wall of the pair of guide arms, and to which a first end of each of a plurality of link plates constituting the parallel crank mechanism is rotatably connected; and a second contact formed as a plurality of flat springs, being arrayed on the second contact array base and being in slidable contact with the extremity portion of the first contact, and having a bent portion in an extremity portion thereof that can connect to a mating-side contact.

In a more detailed second embodiment of the modular jack according to the embodiment of the present invention, the base connector includes:

a rectangular plate-like base housing provided with a substantially rectangular concave portion surrounded by a pair of opposing first side walls and a second side wall which connects first ends of the first side walls, and a first contact array base formed on a bottom wall of the concave portion; and a first contact formed as a plurality of flat springs, an extremity portion thereof protruding from the bottom wall of the concave portion, a middle portion thereof being fixed to the first contact array base, and a base end portion thereof protruding to the outside of the second side wall of the base housing and being joined to the printed circuit board, and the socket connector includes:

a plate-like socket housing provided with a second contact array base that is positioned at a central portion of the socket connector and faces the first contact array base so as to overlap the first contact array base, and a connection portion to which a first end of each of a plurality of link plates constituting the parallel crank mechanism is rotatably connected, the socket housing being disposed to be housed inside the concave portion of the base housing while both side faces thereof are guided by inner walls of the first side walls; and a second contact formed as a plurality of flat springs, being arrayed on the second contact array base and being in contact with the extremity portion of the first contact, and having a bent portion in an extremity portion thereof that can connect to a mating-side contact.

In the more detailed first or second embodiment of the modular jack according to the embodiment of the present invention, the plurality of link plates includes two pairs of link plates, a first pair of the two pairs of link plates having guide pawls that guide a pair of side faces of the plug housing.

In the more detailed first embodiment of the modular jack according to the embodiment of the present invention, the pair of guide arms have opposing grooves that extend from the first contact array base to an extremity of each of the guide arms;

the socket housing has a pair of projecting portions that protrude in opposite directions and are guided by the grooves, in both end portions of the base portion; and the grooves have first stop projections that engage with the projecting portions to maintain the socket housing in a stored state with respect to the base housing, and second stop projections that engage with the projecting portions to maintain the socket housing in a pulled-out state with respect to the base housing, the first stop projections and the second stop projections protruding from a bottom face of the grooves.

In the more detailed second embodiment of the modular jack according to the embodiment of the present invention, the pair of first side walls have opposing grooves that extend from the second side wall to extremities of the first side walls;

the socket housing has a pair of projecting portions that protrude in opposite directions and are guided by the grooves, in both side portions of the socket housing; and the grooves have first stop projections that engage with the projecting portions to maintain the socket housing in a stored state with respect to the base housing, and second stop projections that engage with the projecting portions to maintain the socket housing in a pulled-out state with respect to the base housing, the first stop projections and the second stop projections protruding from a bottom face of the grooves.

According to the modular jack of the present invention, in a state in which the upper housing is lowered toward the front side of the socket housing, the socket connector can be housed inside the casing, and both faces of the upper housing, the socket housing, and the base housing are formed in a flat plate-like shape.

DETAILED DESCRIPTION OF THE INVENTION

Hereinafter, embodiments of the present invention are explained with reference to the drawings.

First Embodiment

Configuration of Modular Jack

Figure 1A:
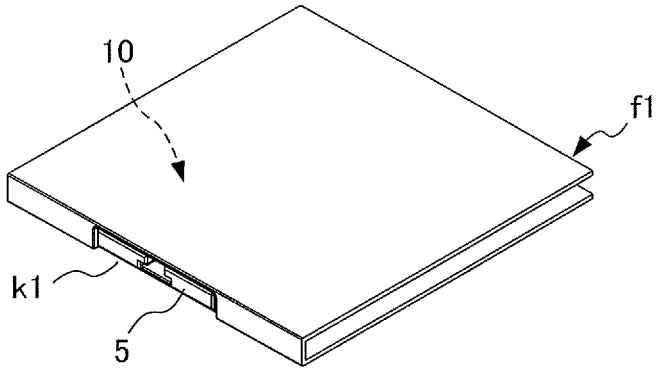
FIG. 1A is a diagram illustrating a state in which a modular jack of a first embodiment is housed inside a casing.
Figure 1B:
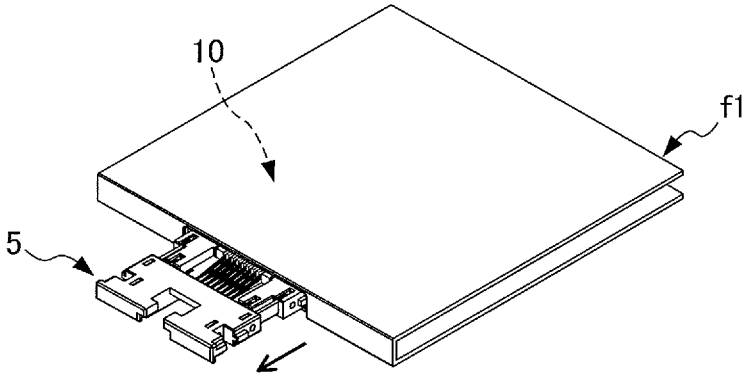
FIG. 1B is a diagram illustrating a state in which a socket connector provided in the modular jack of the first embodiment is pulled out from the casing.
Figure 1C:
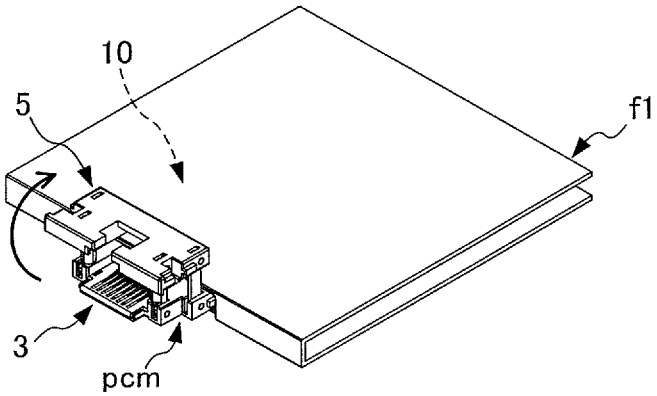
FIG. 1C is a diagram illustrating a state in which an upper housing provided in the socket connector is raised from the state shown in FIG. 1B.
Figure 1D:
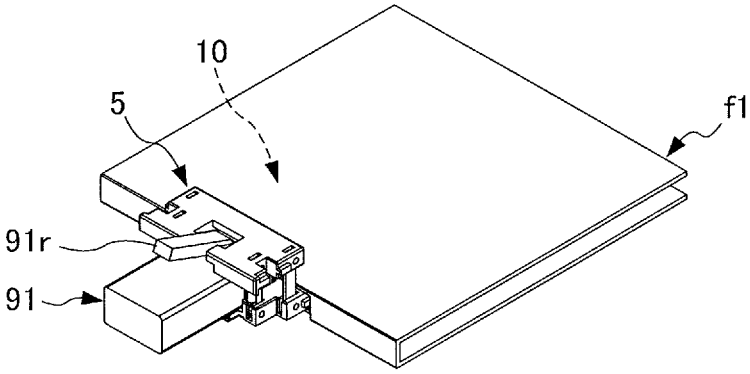
FIG. 1D is a diagram illustrating a state in which a modular plug is connected to the modular jack in a state shown in FIG. 1C.

First, a configuration of a modular jack according to a first embodiment of the present invention is described. FIGS. 1A to 1D are perspective views illustrating the configuration of the modular jack according to the first embodiment of the present invention. FIG. 1A is a diagram illustrating a state in which the modular jack of the first embodiment is housed inside a casing; FIG. 1B is a diagram illustrating a state in which a socket connector provided in the modular jack of the first embodiment is pulled out from the casing; FIG. 1C is a diagram illustrating a state in which an upper housing provided in the socket connector is raised from the state shown in FIG. 1B; and FIG. 1D is a diagram illustrating a state in which a modular plug is connected to the modular jack in a state shown in FIG. 1C.

Figure 2A:
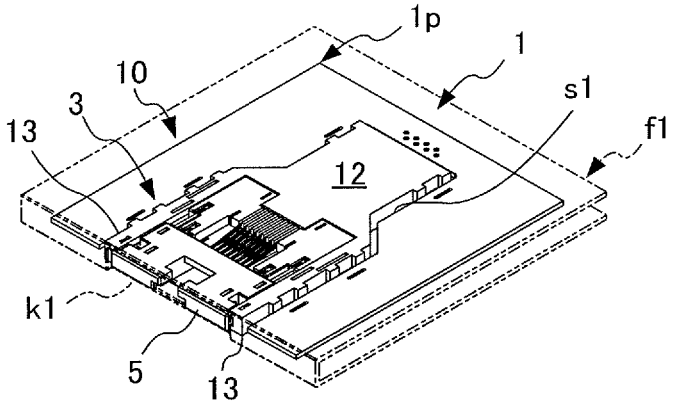
FIG. 2A is a diagram illustrating a state in which the modular jack of the first embodiment is stored inside the casing, showing the casing with imaginary lines.
Figure 2B:
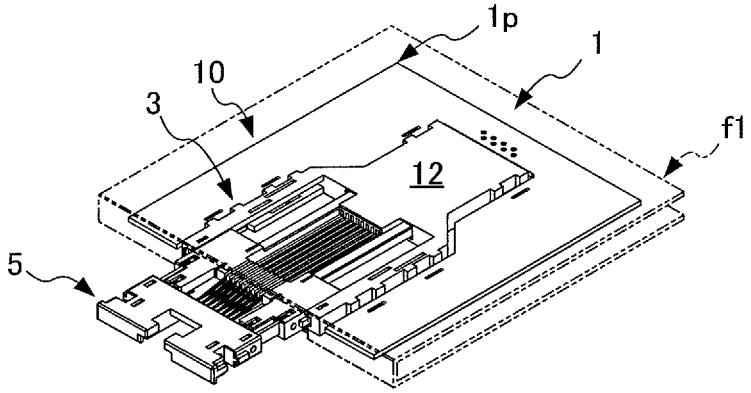
FIG. 2B is a diagram illustrating a state in which the socket connector provided in the modular jack of the first embodiment is pulled out from the casing, showing the casing with imaginary lines.
Figure 2C:
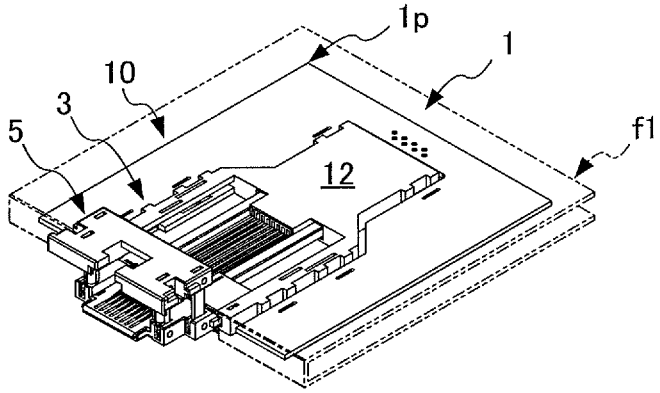
FIG. 2C is a diagram illustrating a state in which an upper housing provided in the socket connector is raised from the state shown in FIG. 2B, showing the casing with imaginary lines.
Figure 2D:
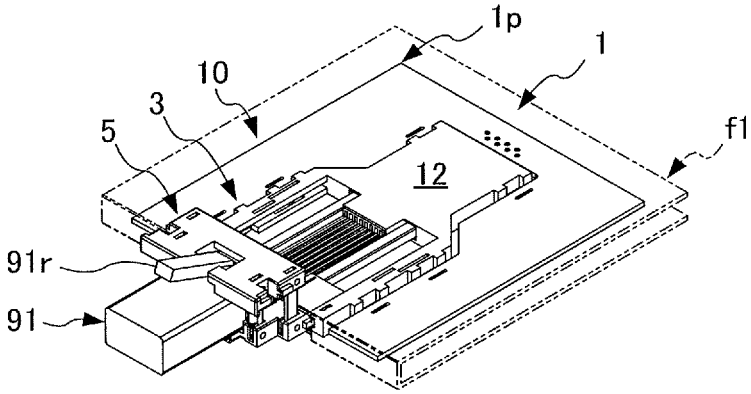
FIG. 2D is a diagram illustrating a state in which the modular plug is connected to the modular jack in a state shown in FIG. 2C, showing the casing with imaginary lines.

FIGS. 2A to 2D are perspective views illustrating a configuration of the modular jack according to the first embodiment, showing the casing with imaginary lines. FIG. 2A is a diagram illustrating a state in which the modular jack of the first embodiment is housed inside the casing; FIG. 2B is a diagram illustrating a state in which the socket connector provided in the modular jack of the first embodiment is pulled out from the casing; FIG. 2C is a diagram illustrating a state in which an upper housing provided in the socket connector is raised from the state shown in FIG. 2B; and FIG. 2D is a diagram illustrating a state in which a modular plug is connected to the modular jack in a state shown in FIG. 2C.

Figure 3:
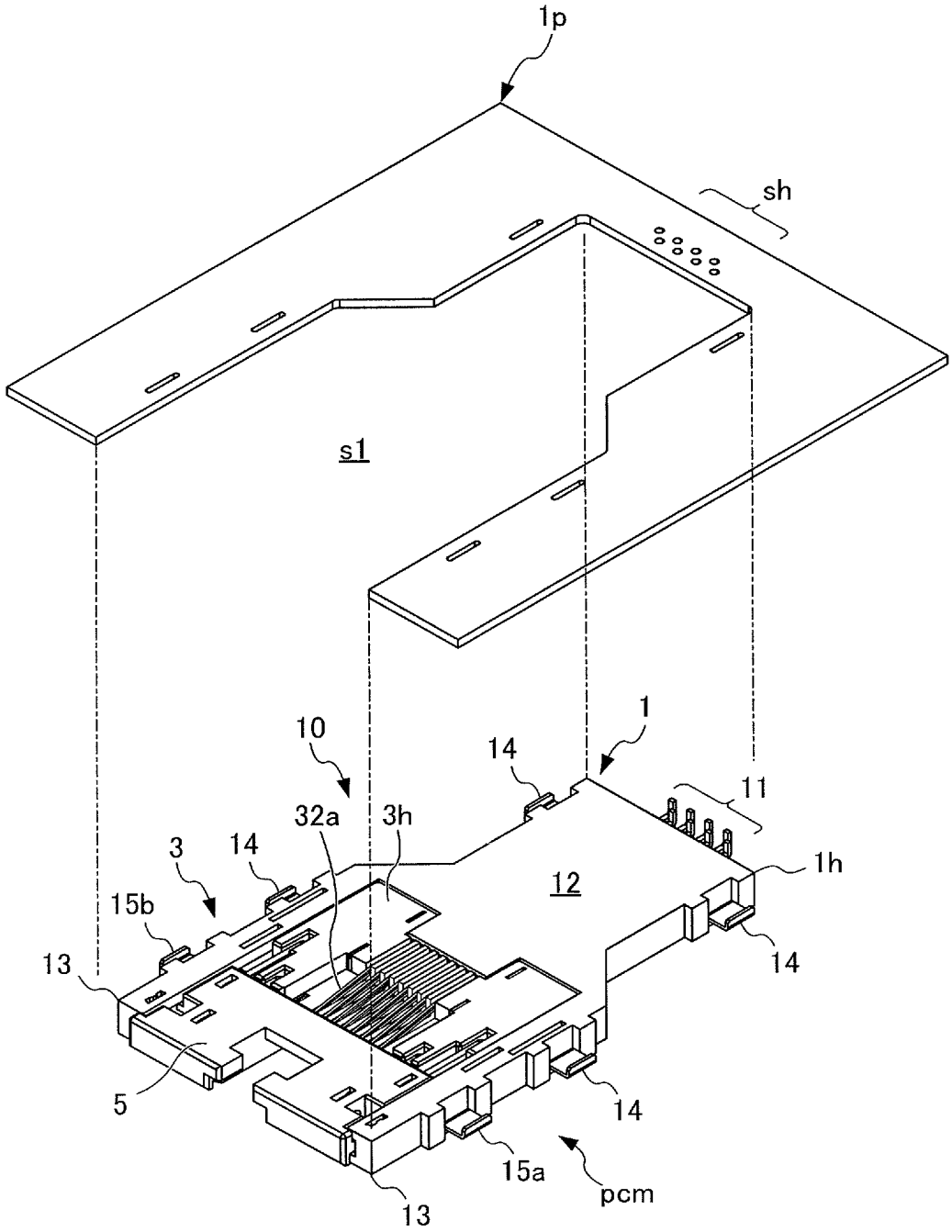
FIG. 3 is a perspective view illustrating a configuration of the modular jack of the first embodiment, disposed to face a printed circuit board inside the casing.
Figure 4:
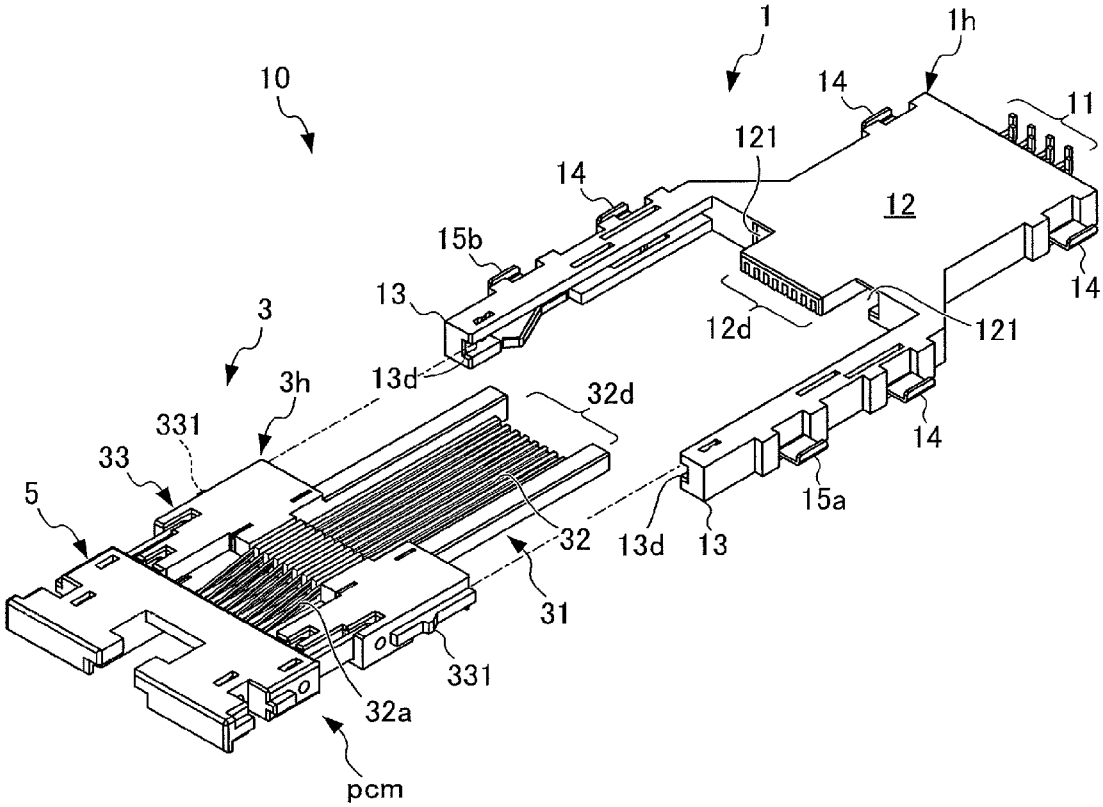
FIG. 4 is a perspective view illustrating a configuration of the modular jack of the first embodiment in a state in which a base housing and the socket connector are disposed to face each other.

FIG. 3 is a perspective view illustrating a configuration of the modular jack of the first embodiment, disposed to face a printed circuit board inside the casing. FIG. 4 is a perspective view illustrating a configuration of the modular jack of the first embodiment in a state in which the base housing composing the modular jack and the socket connector are disposed to face each other.

Figure 5:
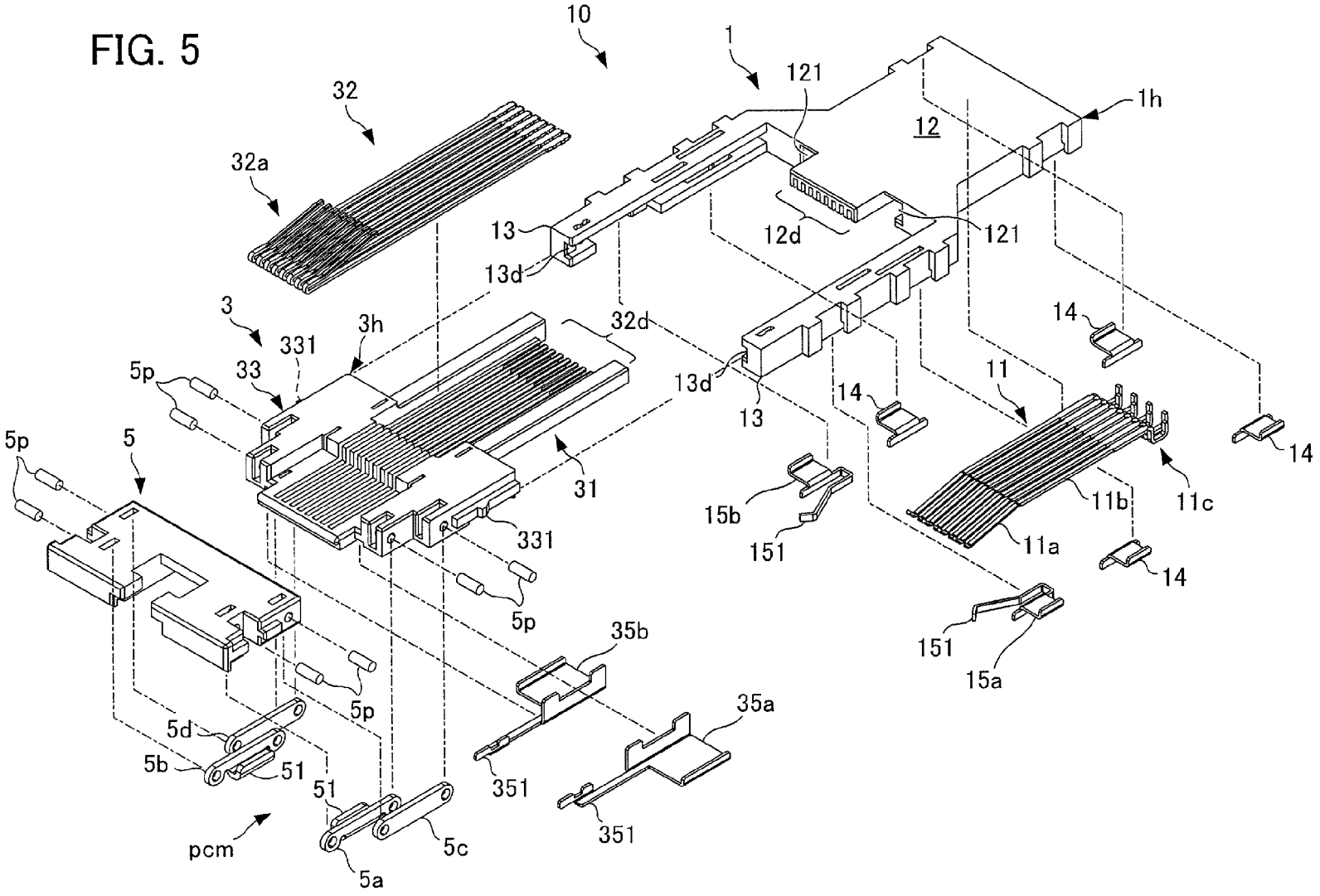
FIG. 5 is an exploded perspective view illustrating a configuration of the modular jack of the first embodiment.
Figure 6G:
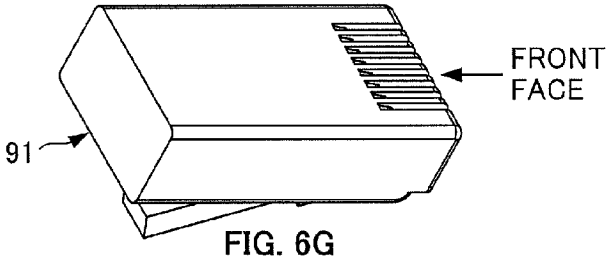
FIG. 6G is a perspective view of the modular plug.
Figure 6F:
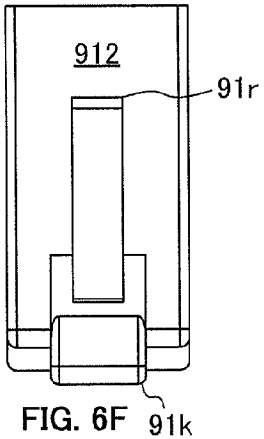
FIG. 6F is a bottom view of the modular plug.
Figure 6C:
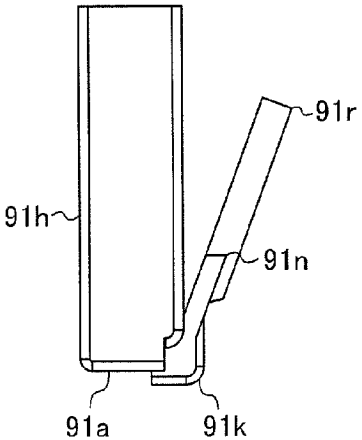
FIG. 6C is a right side view of the modular plug.
Figure 6E:
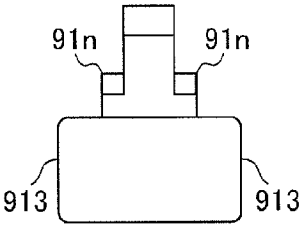
FIG. 6E is a rear view of the modular plug.
Figure 6B:
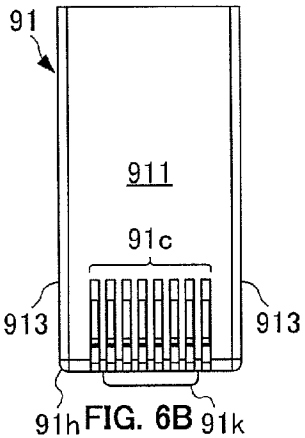
FIG. 6B is a plan view of the modular plug.
Figure 6A:
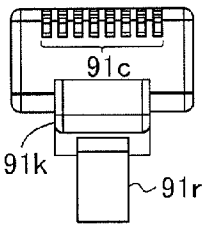
FIG. 6A is a front view of the modular plug.
Figure 6D:
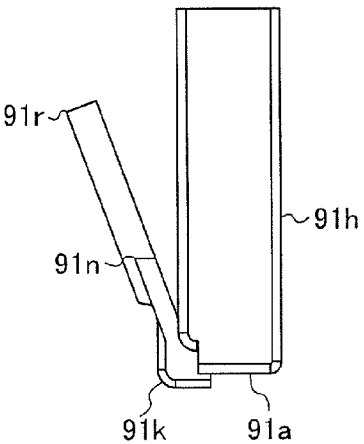
FIG. 6D is a left side view of the modular plug.

FIG. 5 is an exploded perspective view illustrating a configuration of the modular jack of the first embodiment. FIGS. 6A to 6G are diagrams illustrating a configuration of the modular plug: FIG. 6A is a front view; FIG. 6B is a plan view; FIG. 6C is a right side view; FIG. 6D is a left side view; FIG. 6E is a rear view; FIG. 6F is a bottom view; and FIG. 6G is a perspective view.

Overall Configuration

With reference to FIGS. 1A to 5, the modular jack (hereinafter simply referred to as "jack") 10 of the first embodiment is provided with a base connector 1 and the socket connector 3. The base connector 1 is mounted on the printed circuit board 1*p*. The printed circuit board 1*p* is disposed inside the flat casing f1 with a rectangular opening k1 on a side face thereof. The flat casing f1 is illustrated as a part of a casing of the electronic device. A side wall of the base connector 1 is held along an edge portion of the printed circuit board 1*p*. More specifically, the side wall of the base connector 1 is held in a slot cutout s1, which faces the opening k1, on the printed circuit board 1*p*. The slot cutout s1 is composed of seven sides made on the printed circuit board 1*p*, and has a front half portion on a front side and a rear half portion on a rear side with a smaller width than that of the front half portion. The socket connector 3 is slidably connected to the base connector 1. The socket connector 3 is also provided with a parallel crank mechanism pcm at an extremity portion thereof. The parallel crank mechanism pcm allows switching of the upper housing 5, which can engage with a latching tab 91*r*, between a lowered state and a raised state.

Configuration of Modular Plug

With reference to FIG. 1D or FIG. 6, the modular plug (hereinafter simply referred to as "plug") 91 is illustrated as an RJ45 plug. The plug 91 includes a plug housing 91*h*, a key 91*k*, and eight contacts 91*c* which are mating-side contacts. The plug housing 91*h* is configured to have a cuboidal outer shape and includes a first face 911, a second face 912, a first end face 91*a*, and a pair of side faces 913, 913, that are adjacent to these faces. The key 91*k* has a square prism shape and projects from the first end face 91*a* of the plug housing 91*h*. In addition, a part of the key 91*k* extends to the second face 912 of the plug housing 91*h*.

The plug housing 91*h* is provided with the latching tab 91*r*. The latching tab 91*r* is disposed on the second face 912 of the plug housing 91*h*, and a base end portion thereof connects with the key 91*k*. The latching tab 91*r* has a pair of engaging pawls 91*n*, 91*n*.

On an end portion of the first face 911 of the plug housing 91*h*, eight comb-teeth grooves are formed. The plate-like contacts 91*c* are arranged in the grooves. Faces of the contacts 91*c* showing plate-thickness thereof are exposed and can contact a bent portion 32*a* provided in an extremity portion of a second contact 32 shown in FIG. 5.

Configuration of Modular Jack

Figure 7:
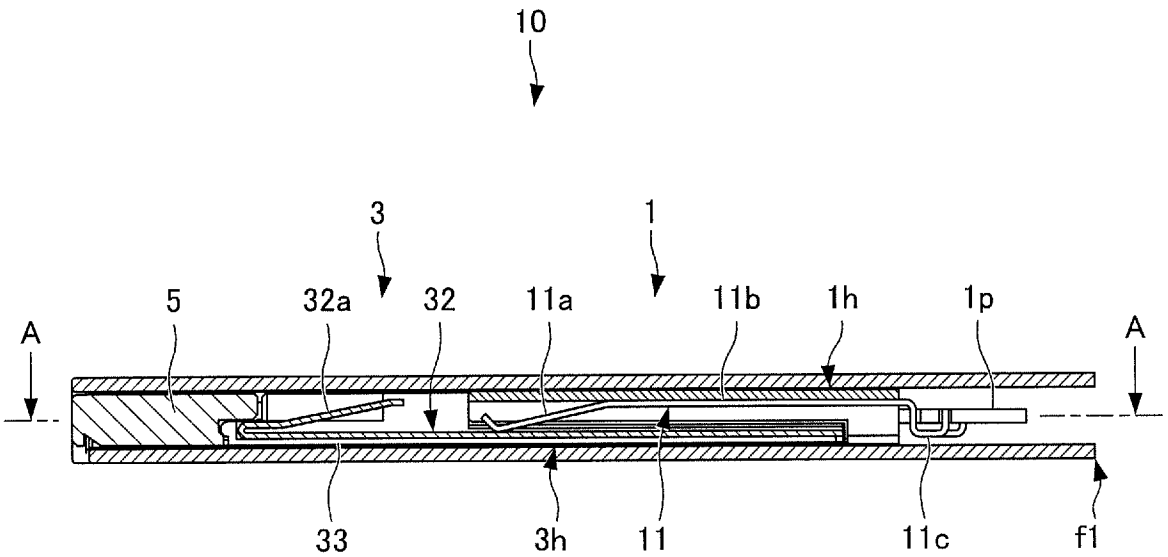
FIG. 7 is a vertical cross-sectional view illustrating a configuration of the modular jack of the first embodiment in a state in which the socket connector is housed inside the casing.

FIG. 7 is a vertical cross-sectional view illustrating a configuration of the modular jack of the first embodiment in a state in which the socket connector provided in the modular jack of the first embodiment is housed inside the casing.

Figure 8:
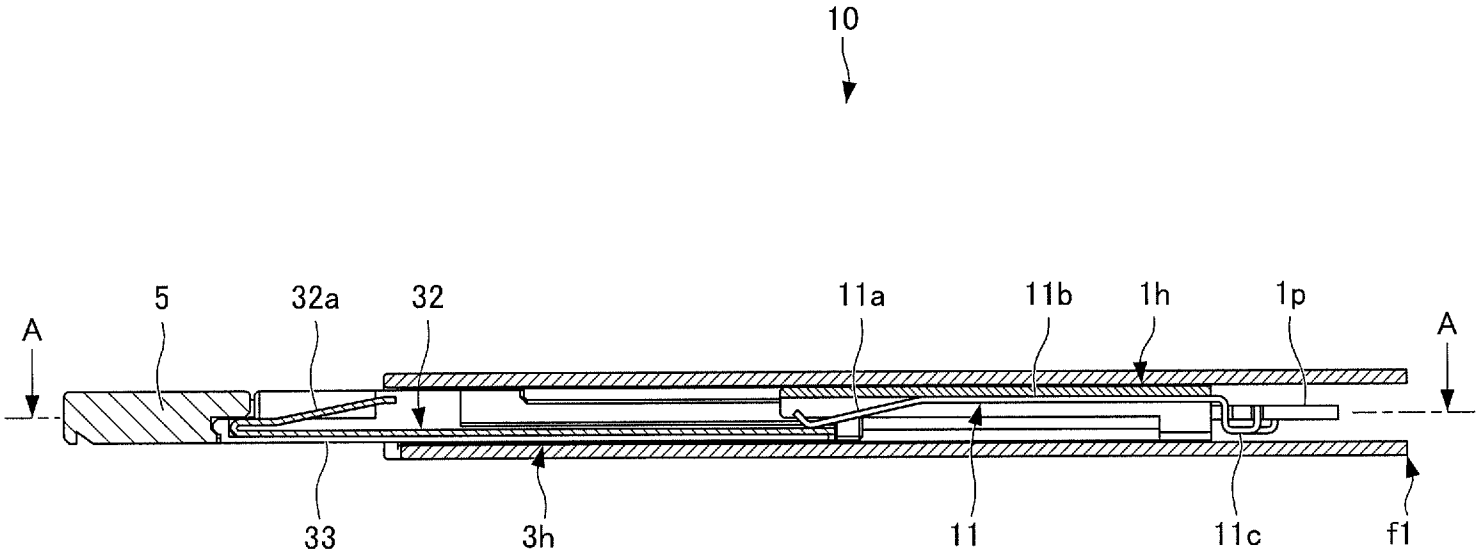
FIG. 8 is a vertical cross-sectional view illustrating a configuration of the modular jack of the first embodiment in a state in which the socket connector is pulled out from the casing.
Figure 9:
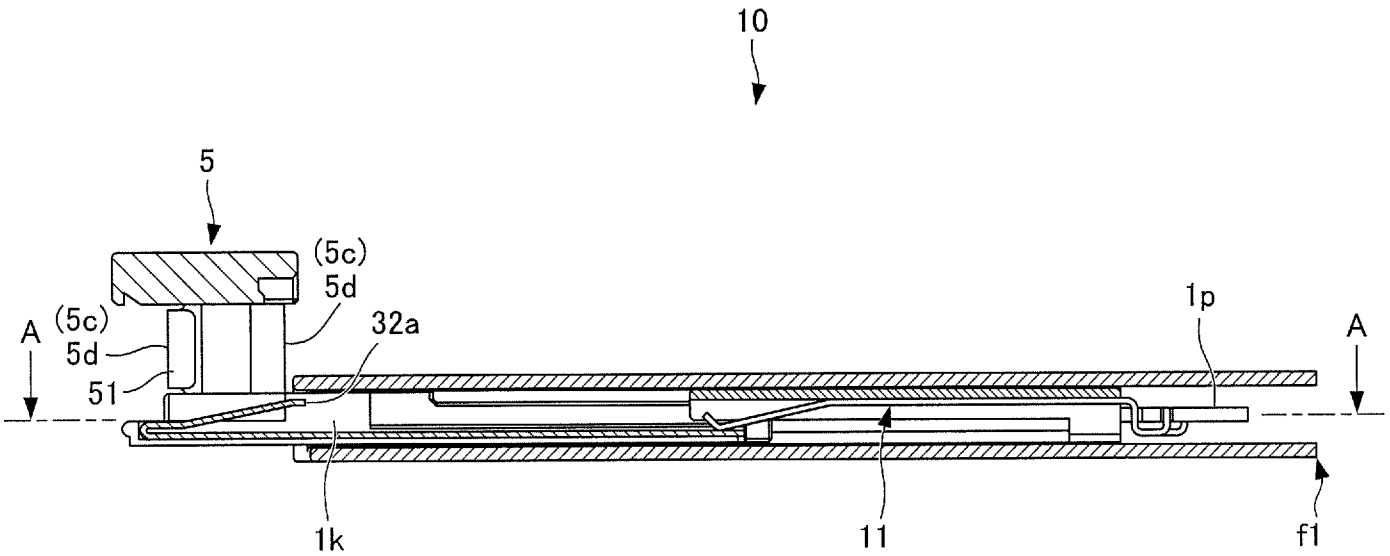
FIG. 9 is a vertical cross-sectional view illustrating a configuration of the modular jack of the first embodiment in a state in which the upper housing provided in the socket connector is raised.

FIG. 8 is a vertical cross-sectional view illustrating a configuration of the modular jack of the first embodiment in a state in which the socket connector provided in the modular jack is pulled out from the casing. FIG. 9 is a vertical cross-sectional view illustrating a configuration of the modular jack of the first embodiment in a state in which the upper housing provided in the socket connector is raised.

Figure 10:
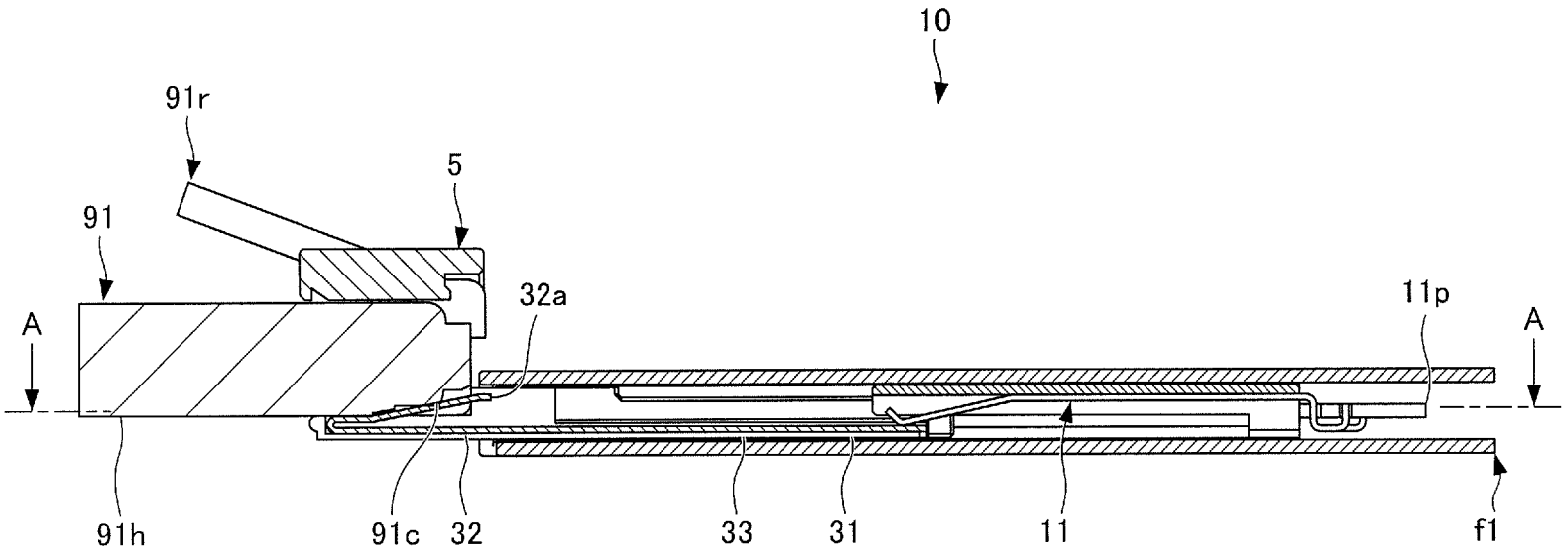
FIG. 10 is a vertical cross-sectional view illustrating a configuration of the modular jack of the first embodiment in a state in which the modular plug is connected to the modular jack.
Figure 11:
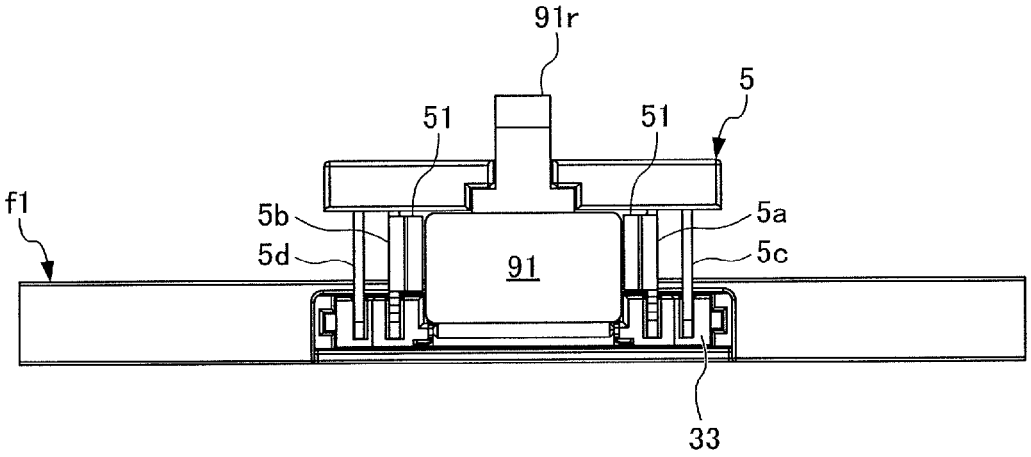
FIG. 11 is a front view illustrating a configuration of the modular jack of the first embodiment in a state of FIG. 10, in a state in which the upper housing provided in the socket connector is raised.

FIG. 10 is a vertical cross-sectional view illustrating a configuration of the modular jack of the first embodiment in a state in which the modular plug is connected to the modular jack. FIG. 11 is a front view illustrating a configuration of the modular jack of the first embodiment in a state of FIG. 10, in a state in which the upper housing provided in the socket connector is raised.

Figure 12:
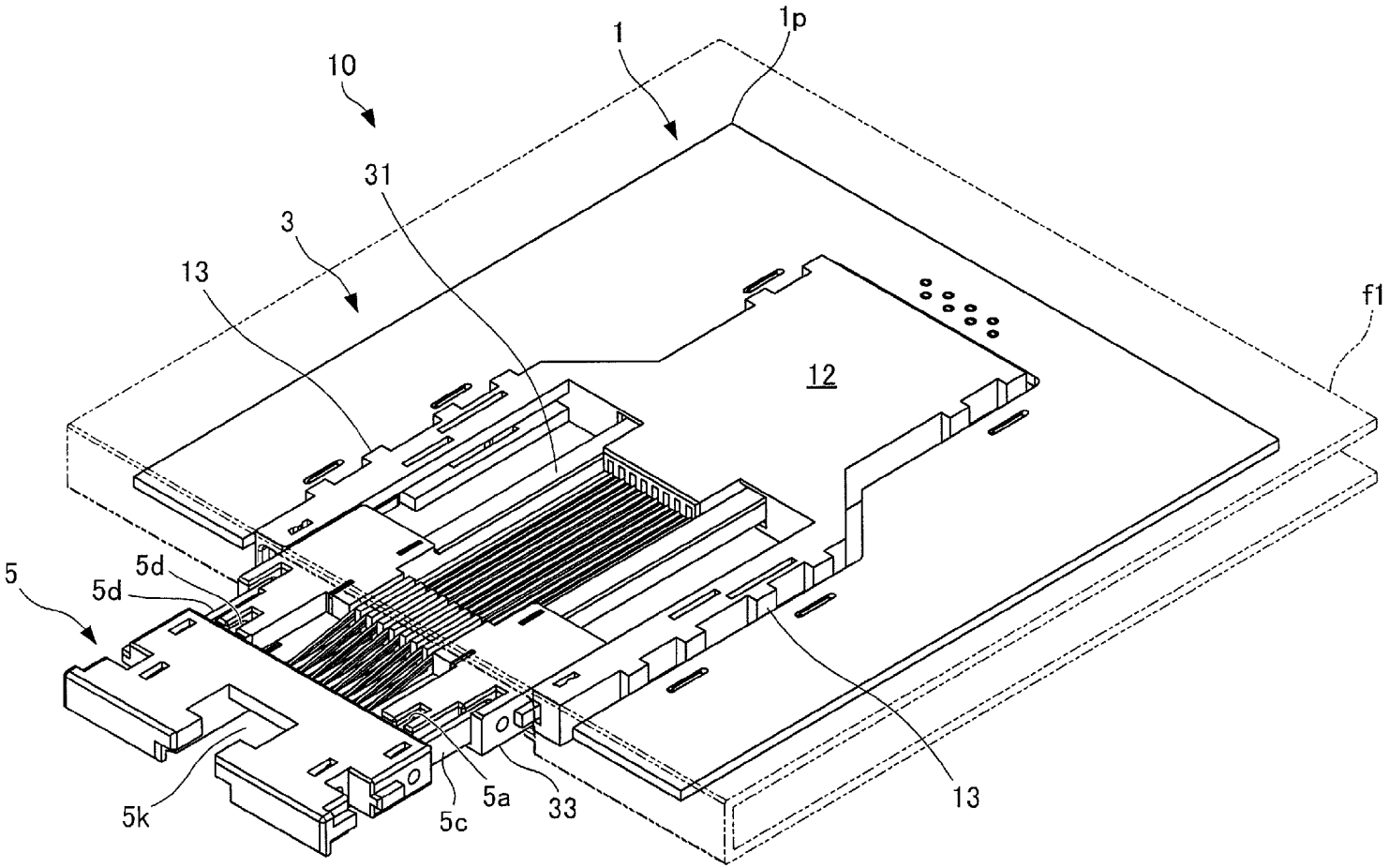
FIG. 12 is a perspective view illustrating a configuration of the modular jack of the first embodiment in a state in which the socket connector is pulled out from the casing.
Figure 13:
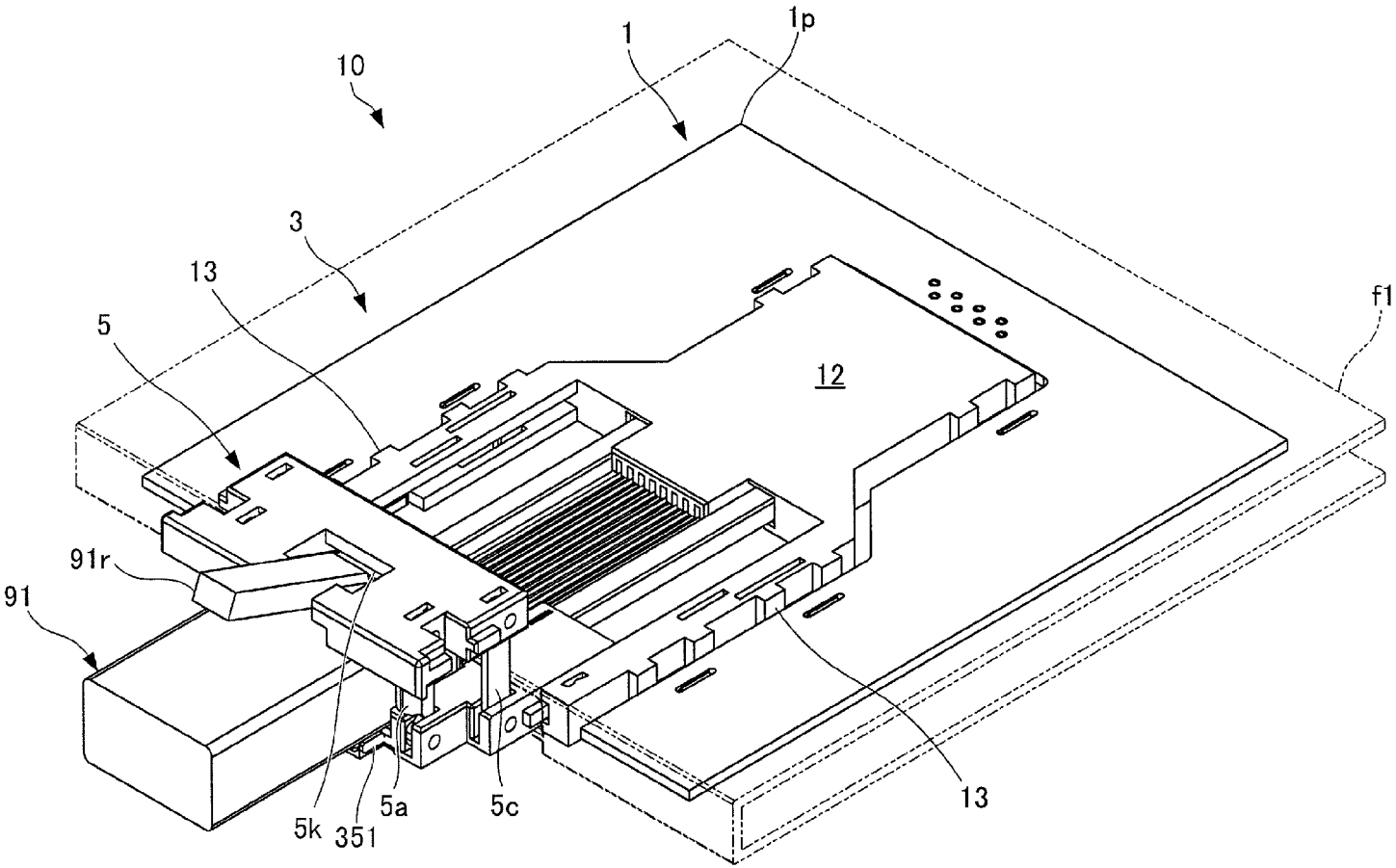
FIG. 13 is a perspective view illustrating a configuration of the modular jack of the first embodiment in a state in which the modular plug is connected to the modular jack.

FIG. 12 is a perspective view illustrating a configuration of the modular jack of the first embodiment in a state in which the socket connector provided in the modular jack is pulled out from the casing. FIG. 13 is a perspective view illustrating a configuration of the modular jack of the first embodiment in a state in which the modular plug is connected to the modular jack.

Configuration of Base Connector

With reference to FIGS. 3 to 5, the base connector 1 includes the plate-like base housing 1*h* and the first contact 11 that is in the form of eight flat springs. The base housing 1*h* is provided with a first contact array base 12 that has a substantially rectangular shape and a pair of opposing guide arms 13, 13. The first contact array base 12 is disposed on the rear side of the slot cutout s1 (see FIGS. 2A to 2D). The pair of guide arms 13, 13 extend from the first contact array base 12 toward the opening k1 (see FIG. 2A).

Configuration of Base Housing

With reference to FIGS. 3 to 5, the base housing 1*h* is formed of a synthetic resin having insulation properties. On a bottom face of the first contact array base 12 of the base housing 1*h*, a groove portion 12*d* having 8 grooves in comb-teeth form is provided (see FIG. 4 or FIG. 5). An intermediate portion 11*b* of the first contact 11 is pressed into the groove portion 12*d* (see FIG. 5).

In addition, a pair of opposing rectangular grooves 121, 121 are formed on both sides of the groove portion 12*d* on the base housing 1*h*. The pair of rectangular grooves 121, 121 can slidably guide both side faces of a second contact array base 31 (described later) (see FIGS. 4 or FIG. 5).

The pair of guide arms 13, 13 have opposing grooves 13*d*, 13*d* that extend from a side of the first contact array base 12 to an extremity of the guide arms 13, 13. On the other hand, the socket housing 3*h* has a pair of projecting portions 331, 331 on both sides of a base portion 33. The pair of projecting portions 331, 331 protrude in opposite directions and are guided into the grooves 13*d*, 13*d* of the pair of guide arms 13, 13. As the pair of guide arms 13, 13 slidably support the both sides of the base portion 33 of the socket housing 3*h*, only a back-and-forth movement is allowed for the socket connector 3.

Configuration of First Contact

With reference to FIGS. 3 to 5, the first contact 11 is composed of a bellows contact that has conductivity, which is a plurality of conductive members in a desired shape obtained by punching or folding a conductive metal plate. In consideration of ease of fabrication, spring characteristics, conductivity, and the like, a copper alloy, for example, is preferably used for the first contact 11; however, the present invention is not limited thereto.

With reference to FIGS. 3 to 5 and 7, the first contact 11 is composed of an extremity portion 11*a* as an elastic arm, an intermediate portion 11*b* as a fixed arm, and a base end portion 11*c* as a lead terminal. In the intermediate portion lib, the conductive members extend linearly and the intermediate portion lib is pressed into the groove portion 12*d* of the first contact array base 12 (see FIG. 5). The base end portion 11*c* protrudes to a side opposite to the guide arms 13. The base end portion 11*c* is a lead terminal that is inserted into a through hole sh provided on the printed circuit board 1*p*, and soldered (see FIG. 3).

With reference to FIG. 5, the extremity portion 11*a*, in which the conductive member is bent at an obtuse angle, extends to an extremity of the intermediate portion 11*b*. The extremity portion 11*a* protrudes from the first contact array base 12 to between the pair of guide arms 13, 13. In addition, the extremity portion 11*a* of the first contact 11 can be slidably in contact with the second contact 32 arrayed in the second contact array base 31 (see FIG. 7).

Configuration of Reinforcing Tab

With reference to FIGS. 3 to 5, the base connector 1 further includes, as a metallic tab, a pair of reinforcing tabs 14 and a pair of reinforcing tabs 15*a*, 15*b* with guide springs. The reinforcing tabs 14 are composed of metallic plates that are bent in a crank shape. A first end of the reinforcing tabs 14 is pressed into the base housing 1*h*, while a second end thereof is inserted into a through hole provided on the printed circuit board 1*p* and soldered. The base connector 1 is thus fixed onto the printed circuit board 1*p*.

The pair of reinforcing tabs 15*a*, 15*b* with guide springs are also metallic plates for fixing the base connector 1 onto the printed circuit board 1*p*, as the reinforcing tabs 14. By directing the pair of guide springs 151, 151 toward the extremity portions of the pair of guide arms 13, 13, the reinforcing tabs 15*a*, 15*b* can be in contact with the pair of conductive members 35*a*, 35*b*.

Configuration of Socket Connector

With reference to FIGS. 3 to 5, the socket connector 3 includes the plate-like socket housing 3*h* and the second contact 32 in the form of eight flat springs. The socket connector 3 includes a substantially rectangular second contact array base 31 and a substantially rectangular base portion 33. The second contact array base 31 is disposed on a base end of the socket housing 3*h* (see FIG. 5). The second contact array base 31 can engage with the first contact array base 12 so as to overlap the first contact array base 12 (see FIG. 3).

Configuration of Socket Housing

With reference to FIGS. 3 to 5, the socket housing 3*h* is formed of a synthetic resin having insulation properties. On an upper face of the socket housing 3*h*, a groove portion 32*d* having eight grooves in comb-teeth form is provided (see FIG. 4 or FIG. 5). The second contact 32 is pressed into the groove portion 32*d* (see FIG. 5).

The base portion 33 is disposed at an extremity of the socket housing 3*h* (see FIG. 5). In addition, both sides of the base portion 33 are guided by inner walls of the pair of guide arms 13, 13. Furthermore, a first end of each of a plurality of link plates 5*a*, 5*b*, 5*c* and 5*d* constituting the parallel crank mechanism pcm is rotatably connected to the base portion 33. The plurality of link plates 5*a*, 5*b*, 5*c* and 5*d* are composed of a first pair of link plates 5*a*, 5*b* and a second pair of link plates 5*c*, 5*d*.

Configuration of Parallel Crank Mechanism

With reference to FIGS. 3 to 5, the parallel crank mechanism pcm is composed of the base portion 33, the upper housing 5, and the link plates 5*a*, 5*b*, 5*c*, 5*d* in a linked configuration. Pivot pins 5*p* are pressed into both side faces of the base portion 33, allowing the first end of each of the plurality of link plates 5*a*, 5*b*, 5*c* and 5*d* to be rotatably connected. Meanwhile, the pivot pins 5*p* are pressed into both side faces of the upper housing 5, allowing the second end of each of the plurality of link plates 5*a*, 5*b*, 5*c* and 5*d* to be rotatably connected.

Since the base portion 33 and the upper housing 5 are connected with each other by means of the parallel crank mechanism pcm, the upper housing 5 is always maintained parallel with respect to the base portion 33. As shown in FIG. 3 or FIG. 7 and FIG. 12, in the lowered state in which the upper housing 5 is laid toward the front side of the base portion 33, the socket connector 3 can be either housed in the casing f1 (see FIG. 7) or pulled out from the casing f1 (see FIG. 12).

On the other hand, as shown in FIG. 9, in the raised state in which the upper housing 5 is pulled out from the opening k1 and raised outside the casing f1, the plug 91 can be inserted between the base portion 33 and the upper housing 5, allowing electrical connection of the plug 91 to the jack 10 (see FIG. 10 or FIG. 11 and FIG. 13).

With reference to FIG. 3 or FIG. 11, the first pair of link plates 5*a*, 5*b* among the plurality of link plates 5*a*, 5*b*, 5*c*, 5*d*, are provided with a pair of opposing guide pawls 51. The guide pawls 51, 51 can guide a pair of side faces 913, 913 of the plug housing 91*h* (see FIG. 6). The plug 91 can thus properly connect to the jack 10, under the control of the pair of guide pawls 51, 51.

Configuration of Second Contact

With reference to FIGS. 3 to 5, the second contact 32 is composed of a bellows contact that has conductivity. In the second contact 32, a main body, in which a plurality of conductive members extend linearly, is arrayed in the second contact array base 31. The extremity portion 11*a* of the first contact 11 is slidably in contact with the main body of the second contact 32 (see FIG. 7 or 8).

In the extremity portion of the second contact 32, the bent portion 32*a* in which the conductive members are arrayed in a state of being bent in a folded-back manner is provided (see FIG. 4). When the plug 91 is inserted between the base portion 33 and the upper housing 5, the contact 91*c*, which is a mating-side contact, can be in contact with the bent portion 32*a* (see FIG. 6 or 10).

Configuration of Conductive Members

With reference to FIG. 5, the socket connector 3 further includes the pair of conductive members 35*a*, 35*b*. In the pair of conductive members 35*a*, 35*b*, respective base end portions thereof fit into the socket housing 3*h* and are in contact with the guide springs 151, 151 of the pair of reinforcing tabs 15*a*, 15*b*, respectively. Meanwhile, respective extremity portions 351, 351 of the pair of conductive members 35*a*, 35*b* protrude slightly from the front face of the socket housing 3*h* (see FIG. 13). If a human body touches the extremity portion 351 of the pair of conductive members 35*a*, 35*b*, an electrical charge of the human body can be released to the printed circuit board 1*p* via the reinforcing tabs 15*a*, 15*b*.

Operation of Modular Jack

Operations and effects of the jack 10 of the first embodiment are described hereinafter by explaining behavior thereof, while giving complementary descriptions on the configuration of the jack 10.

Figure 14A:
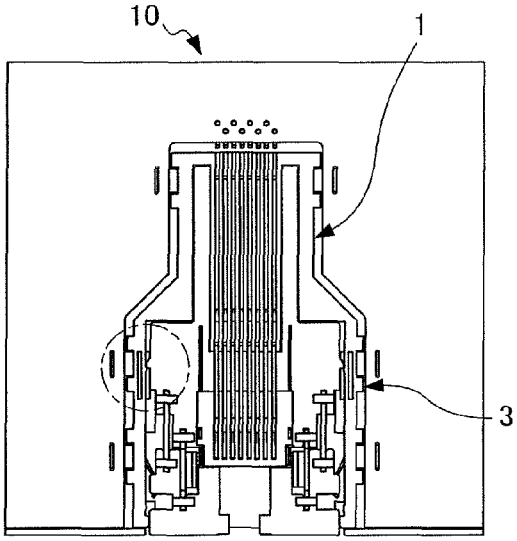
FIG. 14A is a cross-sectional view taken along a line A-A of FIG. 7 illustrating a configuration of the modular jack of the first embodiment.
Figure 14B:
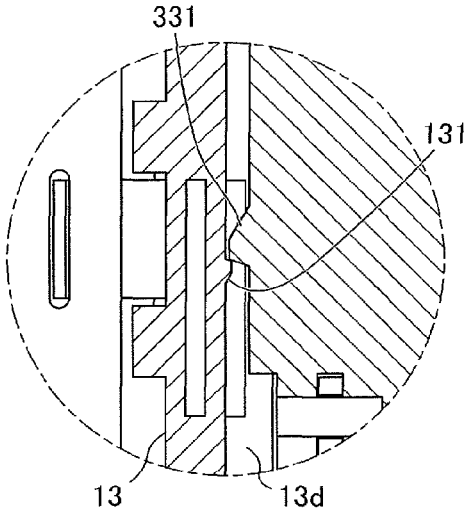
FIG. 14B is an enlarged view of a main portion of FIG. 14A.
Figure 15A:
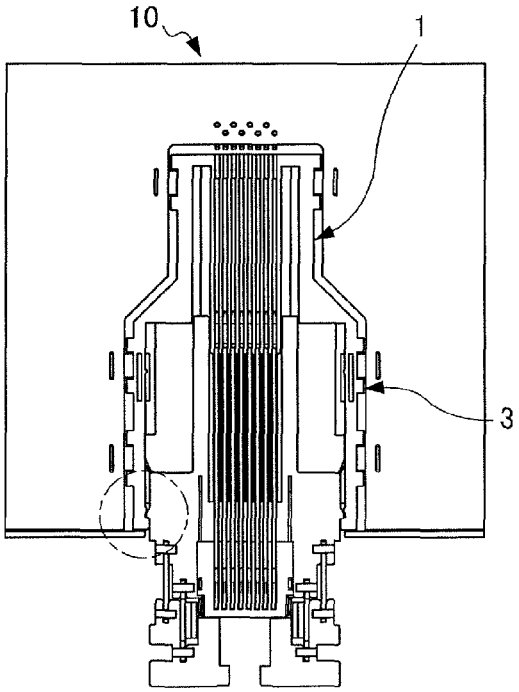
FIG. 15A is a cross-sectional view taken along a line A-A of FIG. 8 illustrating a configuration of the modular jack of the first embodiment.
Figure 15B:
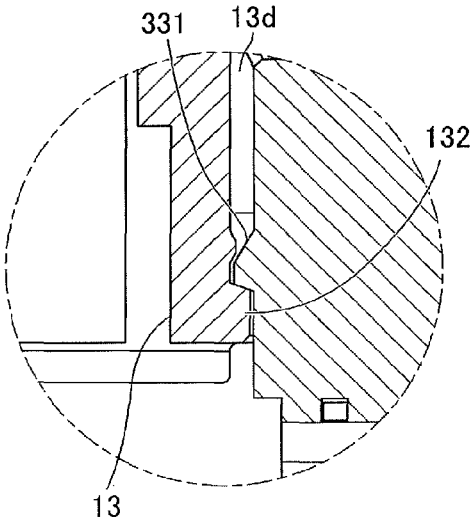
FIG. 15B is an enlarged view of a main portion of FIG. 15A.

FIG. 14A is a cross-sectional view taken along a line A-A of FIG. 7 illustrating a configuration of the modular jack of the first embodiment; and FIG. 14B is an enlarged view of a main portion of FIG. 14A. FIG. 15A is a cross-sectional view taken along a line A-A of FIG. 8 illustrating a configuration of the modular jack of the first embodiment; FIG. 15B is an enlarged view of a main portion of FIG. 15A.

Figure 16:
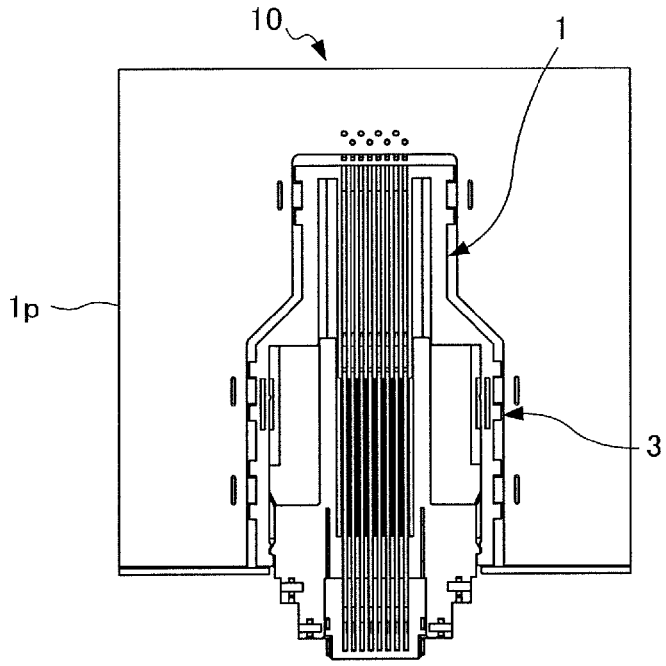
FIG. 16 is a cross-sectional view taken along a line A-A of FIG. 9 illustrating a configuration of the modular jack of the first embodiment.
Figure 17:
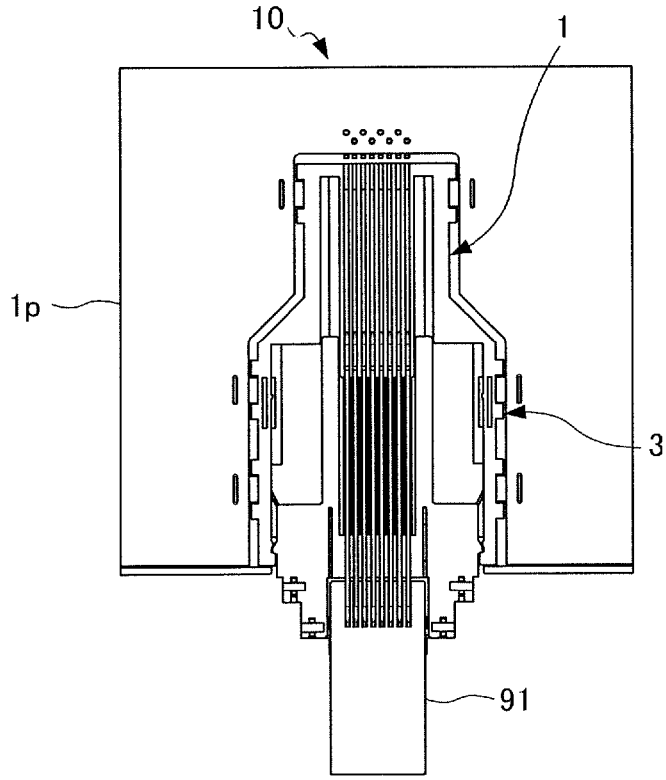
FIG. 17 is a cross-sectional view taken along a line A-A of FIG. 10 illustrating a configuration of the modular jack of the first embodiment.

FIG. 16 is a cross-sectional view taken along a line A-A of FIG. 9 illustrating a configuration of the modular jack of the first embodiment. FIG. 17 is a cross-sectional view taken along a line A-A of FIG. 10 illustrating a configuration of the modular jack of the first embodiment.

As shown in FIG. 1A or 2A, the jack 10 is usually stored inside the casing f1. The opening k1 provided on the side face of the casing f1 is shut by the front face of the upper housing 5.

In the state shown in FIG. 1A or 2A, the socket connector 3 fits into the base connector 1 (see FIG. 3 or 7). With reference to FIG. 14B, a first stop projection 131 is provided on the rear side of the groove 13*d* of the guide arm 13. As the first stop projection 131 engages with the projecting portion 331, the socket housing 3*h* is maintained in a stored state with respect to the base housing 1*h*. By pulling the socket housing 3*h* away from the base housing 1*h* with a force such that the projecting portion 331 can run over the first stop projection 131, the socket housing 3*h* can be pulled out from the base housing 1*h*.

For connecting the plug 91 to the jack 10, the socket connector 3 is first pulled out from the casing f1. In this case, since a concavity is provided on the bottom face of the upper housing 5 as shown in FIG. 7 or 8, the socket connector 3 can be easily pulled out.

FIG. 1B or FIG. 2B and FIG. 8 are diagrams illustrating a state in which the socket connector 3 is completely pulled out from the casing f1. In this case, as shown in FIG. 15B, a second stop projection 132 is provided on an entrance side of the groove 13*d*. The projecting portion 331 thus engages with the second stop projection 132. As a result, the socket housing 3*h* is stably maintained in a pulled out state with respect to the base housing 1*h*. By pulling the socket housing 3*h* away from the base housing 1*h* with a force such that the projecting portion 331 can run over the second stop projection 132, the socket housing 3*h* is released from the stably maintained state. This can prevent, for example, damage to the base connector 1.

From the state shown in FIG. 1B or FIG. 2B and FIG. 8, by rotating the upper housing 5 in a first direction as shown in FIG. 1C or 2C, the upper housing 5 goes into the raised state outside the casing f1 (see FIG. 9 or FIG. 11 and FIG. 13). The plug 91 can thus be inserted between the base portion 33 and the upper housing 5, to be electrically connected to the jack 10 (see FIG. 1D or FIG. 2D).

In the state shown in FIG. 1D or FIG. 2D, the pair of engaging pawls 91*n*, 91*n* of the plug 91 engage with a notched groove 5*k* provided on the upper housing 5 (see FIG. 13). The plug 91 can thus be locked into the socket connector 3. In addition, in the state shown in FIG. 1D or FIG. 2D, the plug 91 and the printed circuit board 1*p* are electrically connected with each other in a sequential path of: the contact 91*c*, the second contact 32, and the first contact 11.

For disconnecting the plug 91, the plug 91 can be released and the socket connector 3 can be stored inside the casing f1 by the above described procedure in reverse order.

In the jack 10 of the first embodiment, in a state in which the upper housing 5 is laid toward the front side of the socket housing 3*h*, the socket connector 3 can be housed inside the casing f1. In other words, in the lowered state of the upper housing 5, both faces of the upper housing 5, the socket housing 3*h*, and the base housing 1*h* are formed in a flat plate-like shape. As a result, with the jack 10 a modular jack of a reduced height can be provided, to realize a reduction in size of an electronic device.

Second Embodiment

Configuration of Modular Jack

Figure 18A:
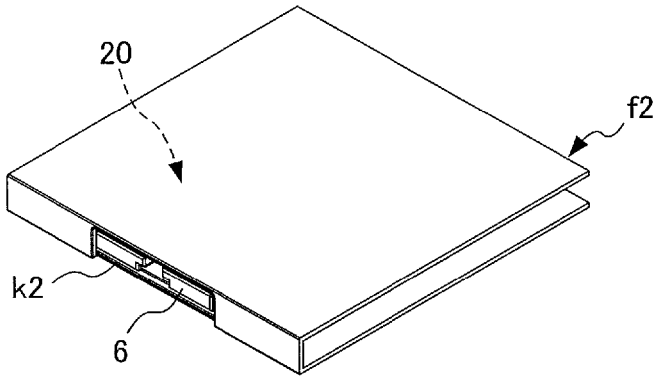
FIG. 18A is a diagram illustrating a state in which a modular jack of a second embodiment is housed inside a casing.
Figure 18B:
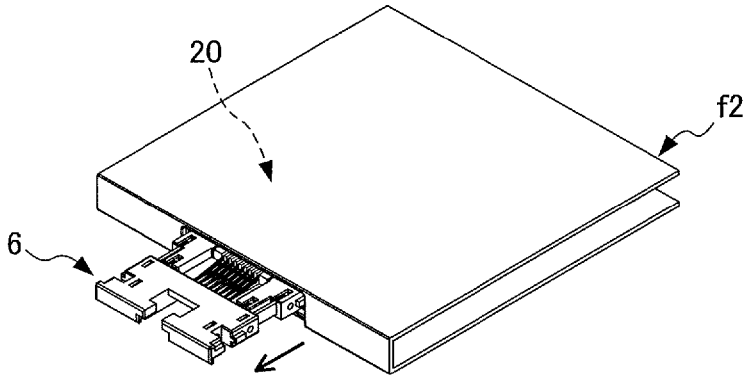
FIG. 18B is a diagram illustrating a state in which a socket connector provided in the modular jack of the second embodiment is pulled out from the casing.
Figure 18C:
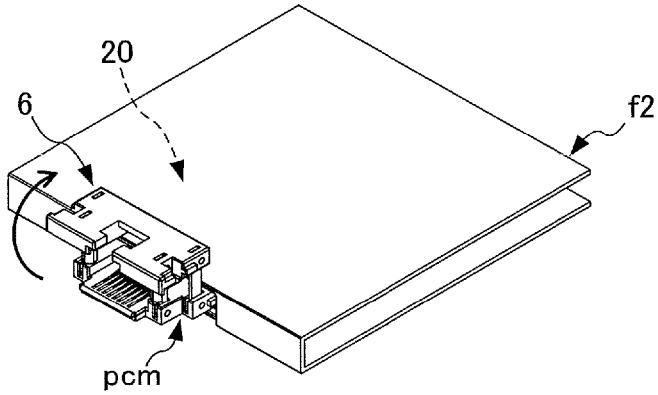
FIG. 18C is a diagram illustrating a state in which the upper housing provided in the socket connector is raised from the state shown in FIG. 18B.
Figure 18D:
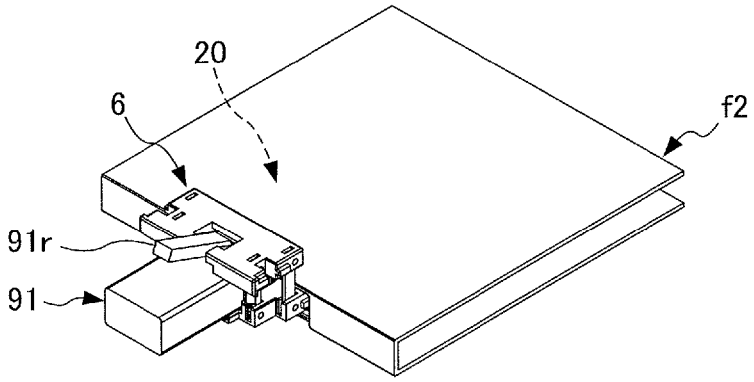
FIG. 18D is a diagram illustrating a state in which the modular plug is connected to the modular jack in a state shown in FIG. 180.

Next, a configuration of a modular jack according to a second embodiment of the present invention is described. FIGS. 18A to 18D are perspective views illustrating a configuration of the modular jack according to the second embodiment of the present invention. FIG. 18A is a diagram illustrating a state in which the modular jack of the second embodiment is housed inside a casing; FIG. 18B is a diagram illustrating a state in which a socket connector provided in the modular jack of the second embodiment is pulled out from the casing; FIG. 18C is a diagram illustrating a state in which the upper housing provided in the socket connector is raised from the state shown in FIG. 18B; and FIG. 18D is a diagram illustrating a state in which a modular plug is connected to the modular jack in the state shown in FIG. 18C.

Figure 19A:
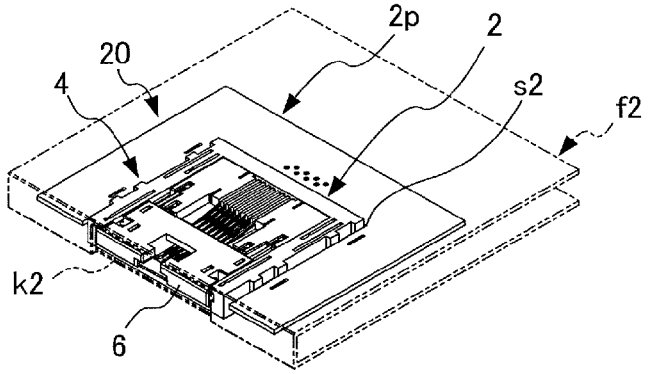
FIG. 19A is a diagram illustrating a state in which the modular jack of the second embodiment is stored inside the casing, showing the casing with imaginary lines.
Figure 19B:
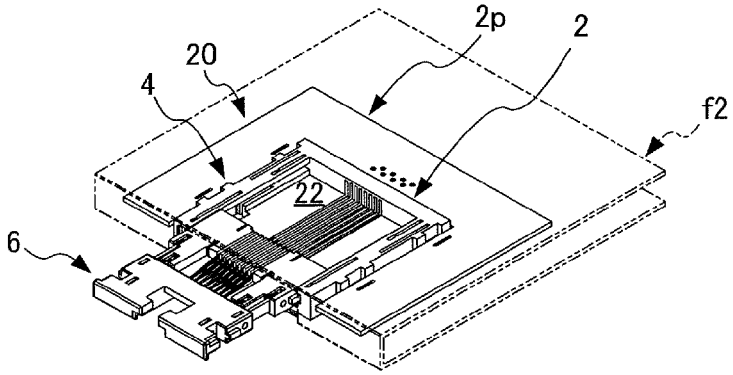
FIG. 19B is a diagram illustrating a state in which the socket connector provided in the modular jack of the second embodiment is pulled out from the casing, showing the casing with imaginary lines.
Figure 19C:
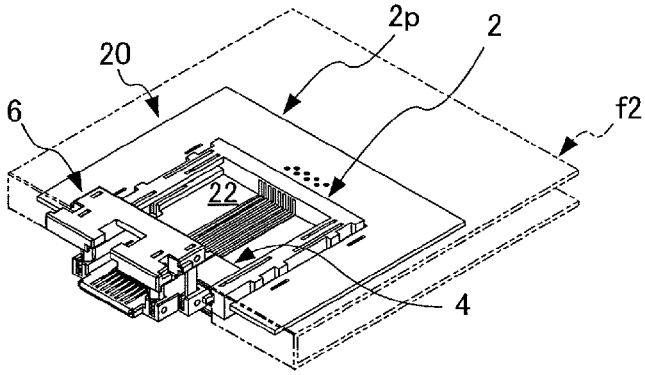
FIG. 19C is a diagram illustrating a state in which an upper housing provided in the socket connector is raised from the state shown in FIG. 19B, showing the casing with imaginary lines.
Figure 19D:
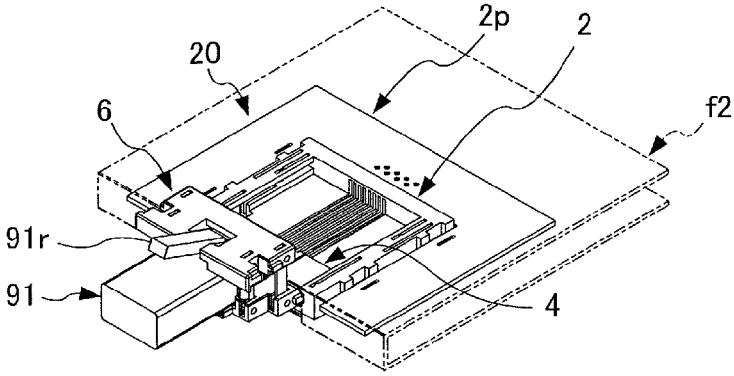
FIG. 19D is a diagram illustrating a state in which the modular plug is connected to the modular jack in a state shown in FIG. 19C, showing the casing with imaginary lines.

FIGS. 19A to 19D are perspective views illustrating a configuration of the modular jack according to the second embodiment, showing the casing with imaginary lines. FIG. 19A is a diagram illustrating a state in which the modular jack of the second embodiment is housed inside the casing; FIG. 19B is a diagram illustrating a state in which a socket connector provided in the modular jack of the second embodiment is pulled out from the casing; FIG. 19C is a diagram illustrating a state in which the upper housing provided in the socket connector is raised from the state shown in FIG. 19B; and FIG. 19D is a diagram illustrating a state in which a modular plug is connected to the modular jack in a state shown in FIG. 19C.

Figure 20:
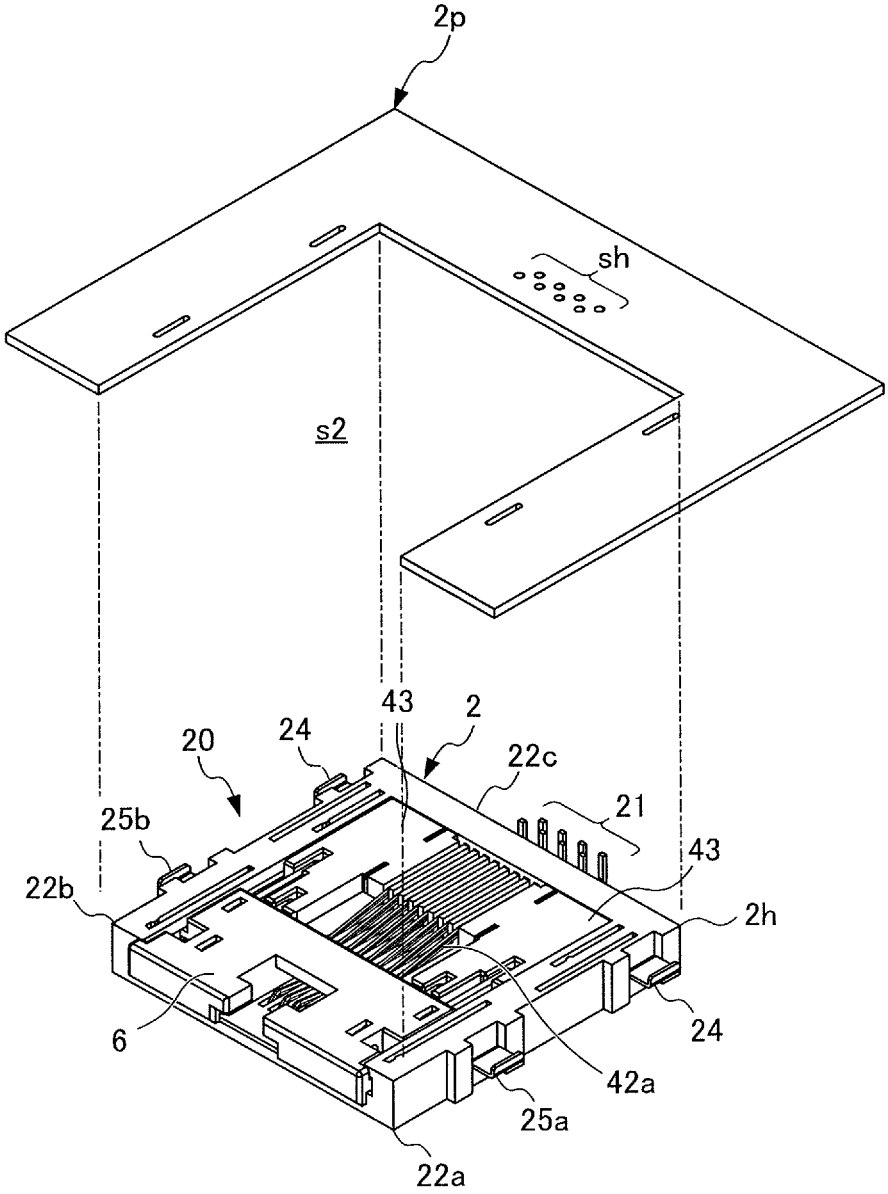
FIG. 20 is a perspective view illustrating a configuration of the modular jack of the second embodiment, disposed to face a printed circuit board inside the casing.
Figure 21:
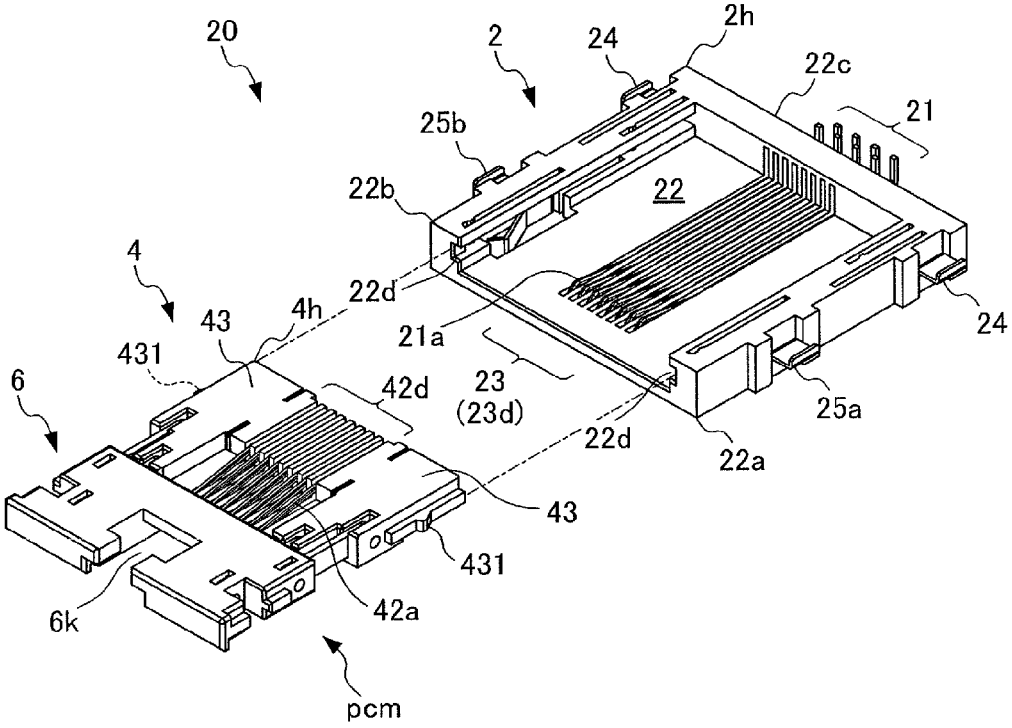
FIG. 21 is a perspective view illustrating a configuration of the modular jack of the second embodiment in a state in which the base housing composing the modular jack and the socket connector are disposed to face each other.
Figure 22:
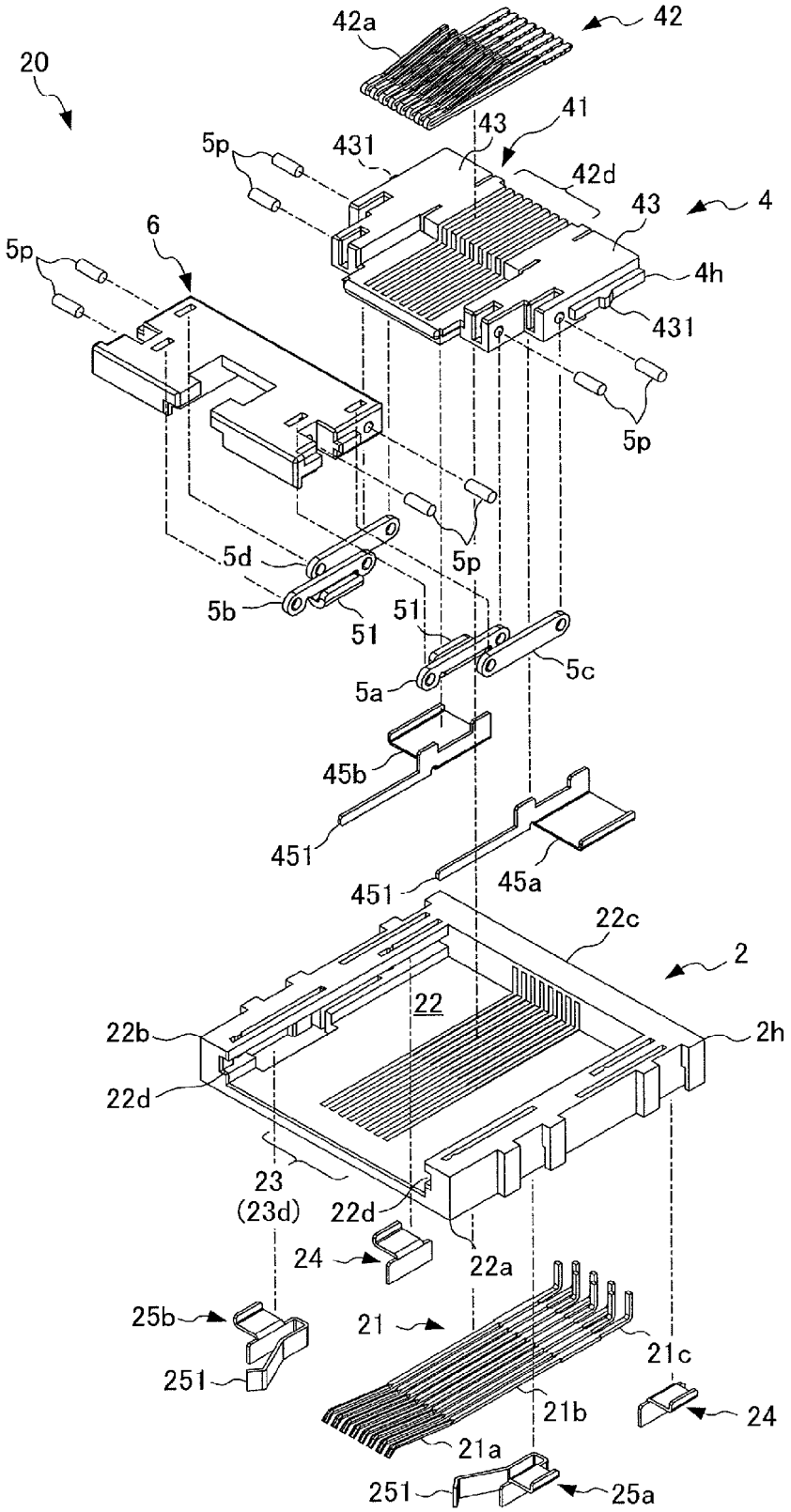
FIG. 22 is an exploded perspective view illustrating a configuration of the modular jack of the second embodiment.

FIG. 20 is a perspective view illustrating a configuration of the modular jack of the second embodiment, disposed to face a printed circuit board inside the casing. FIG. 21 is a perspective view illustrating a configuration of the modular jack of the second embodiment in a state in which the base housing composing the modular jack and the socket connector are disposed to face each other. FIG. 22 is an exploded perspective view illustrating a configuration of the modular jack of the second embodiment.

Overall Configuration

With reference to FIGS. 18 to 22, the jack 20 of the second embodiment is provided with a base connector 2 and the socket connector 4. The base connector 2 is mounted on the printed circuit board 2*p*. The printed circuit board 2*p* is disposed inside the flat casing f2 with a rectangular opening k2 on a side face thereof. The flat casing f2 is illustrated as a part of a casing of the electronic device. A side wall of the base connector 2 is held along an edge portion of the printed circuit board 2*p*. More specifically, the side wall of the base connector 2 is held in a slot cutout s2, which faces the opening k2, on the printed circuit board 2*p*. The slot cutout s2 has a rectangular shape composed of three sides made on the printed circuit board 2*p*. The socket connector 4 is slidably connected to the base connector 2. The socket connector 4 is also provided with a parallel crank mechanism pcm at an extremity portion thereof. The parallel crank mechanism pcm allows switching of the upper housing 6, which can engage with the latching tab 91*r*, between the lowered state and the raised state.

Configuration of Modular Jack

Figure 23:
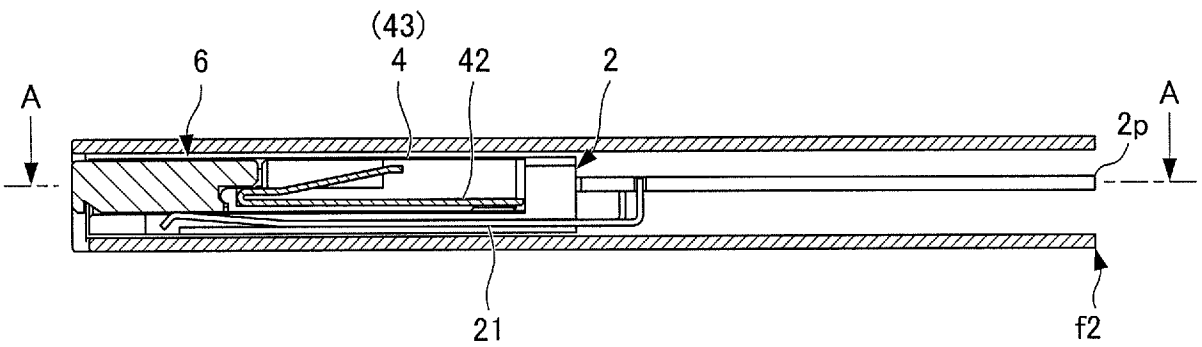
FIG. 23 is a vertical cross-sectional view illustrating a configuration of the modular jack of the second embodiment in a state in which the socket connector provided in the modular jack is housed inside the casing.

FIG. 23 is a vertical cross-sectional view illustrating a configuration of the modular jack of the second embodiment in a state in which the socket connector provided in the modular jack of the second embodiment is housed inside the casing.

Figure 24:
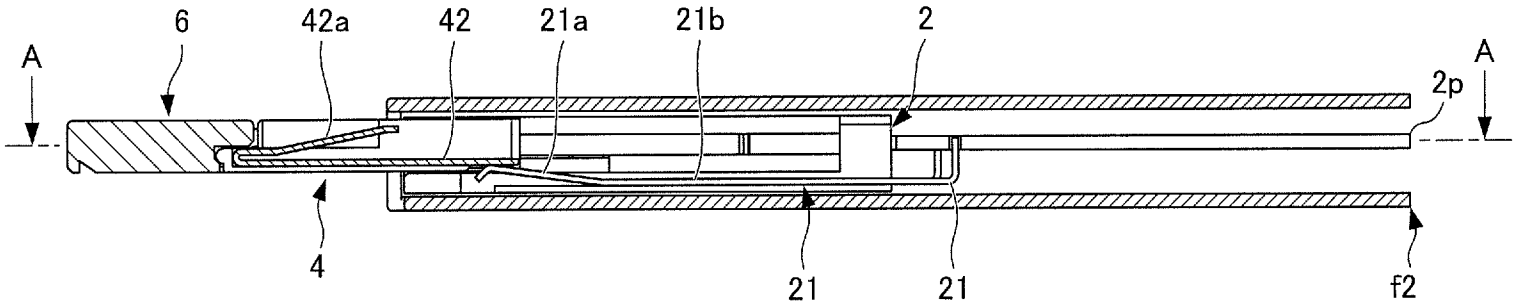
FIG. 24 is a vertical cross-sectional view illustrating a configuration of the modular jack of the second embodiment in a state in which the socket connector provided in the modular jack is pulled out from the casing.

FIG. 24 is a vertical cross-sectional view illustrating a configuration of the modular jack of the 2 embodiment in a state in which the socket connector provided in the modular jack is pulled out from the casing.

Figure 25:
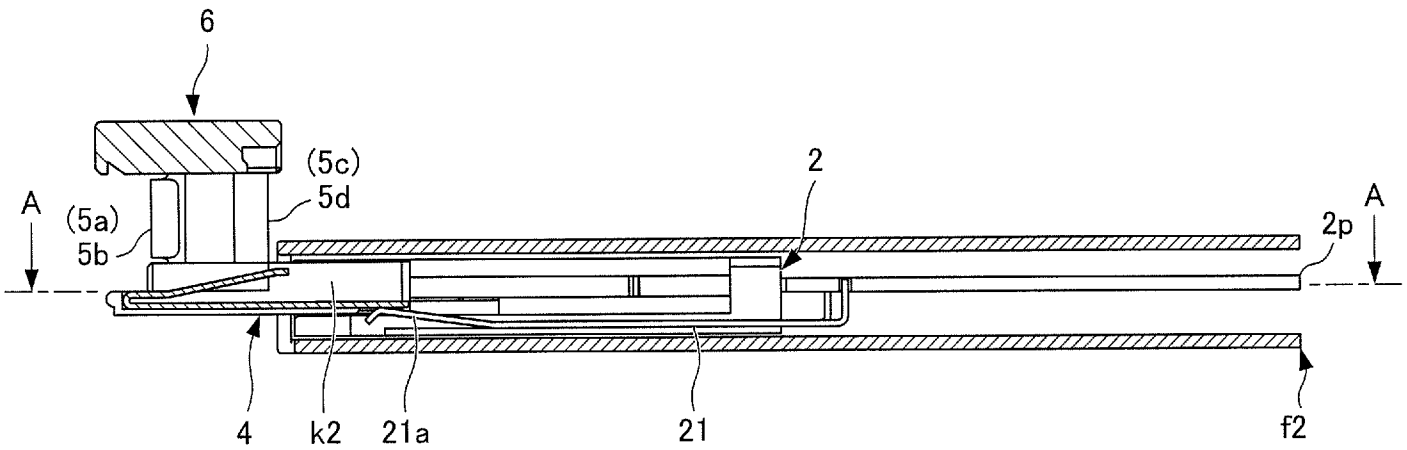
FIG. 25 is a vertical cross-sectional view illustrating a configuration of the modular jack of the second embodiment in a state in which the upper housing provided in the socket connector is raised.
Figure 26:
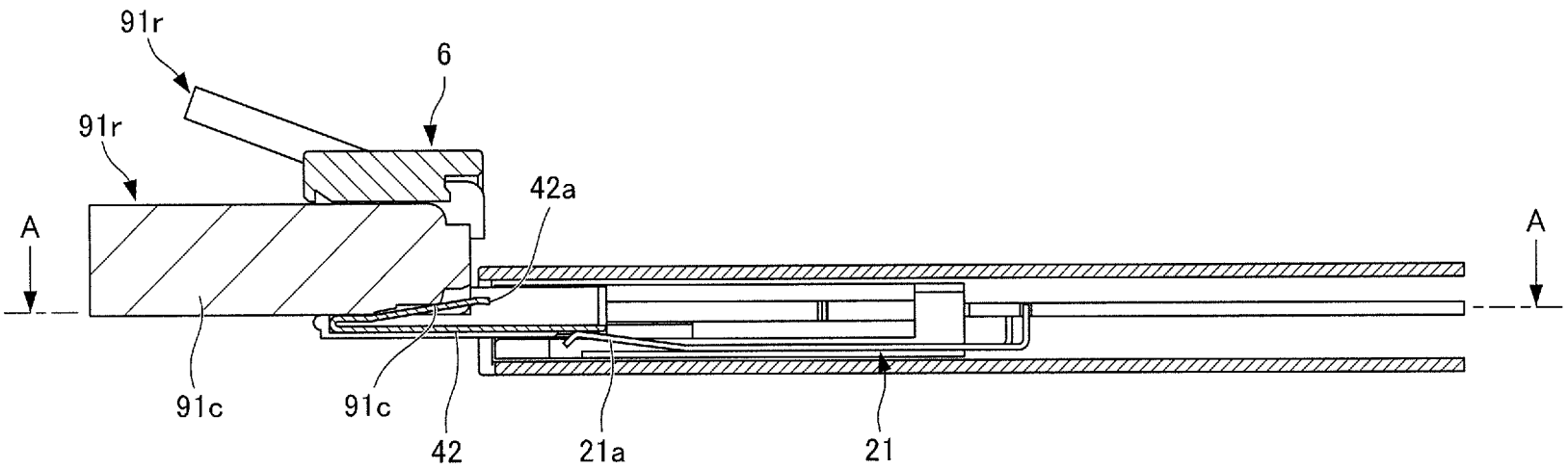
FIG. 26 is a vertical cross-sectional view illustrating a configuration of the modular jack of the second embodiment in a state in which the modular plug is connected to the modular jack.

FIG. 25 is a vertical cross-sectional view illustrating a configuration of the modular jack of the 2 embodiment in a state in which the upper housing provided in the socket connector is raised. FIG. 26 is a vertical cross-sectional view illustrating a configuration of the modular jack of the 2 embodiment in a state in which the modular plug is connected to the modular jack.

Configuration of Base Connector

With reference to FIGS. 20 to 22, the base connector 2 includes the plate-like base housing 2*h* and the first contact 21 in the form of eight flat springs. The base housing 2*h* is provided with a concave portion 22 in a substantially rectangular shape, and the first contact array base 23. The concave portion 22 is surrounded by: a pair of opposing first side walls 22*a*, 22*b*; and a second side wall 22*c* that connects first ends of the first side walls 22*a*, 22*b*. The first contact array base 23 is formed in a central portion of a bottom wall of the concave portion 22 (see FIG. 22).

Configuration of Base Housing

With reference to FIG. 21 or 22, the base housing 2*h* is formed of a synthetic resin having insulation properties. On the bottom face of the concave portion 22 of the base housing 2*h*, a groove portion 23*d* having eight grooves in comb-teeth form is provided. A part of the groove portion 23*d* penetrates into the bottom face of the concave portion 22 and a bottom face of the base housing 2*h*, as well as into the second side wall 22*c*. An intermediate portion 21*b* of the first contact 21 is pressed into the groove portion 23*d* (see FIG. 22). Three peripheral sides of the base housing 2*h* are surrounded by the slot cutout s2.

The pair of first side walls 22*a*, 22*b* have opposing grooves 22*d*, 22*d* that extend from the second side wall 22*c* to extremities of the first side walls 22*a*, 22*b*. On the other hand, the socket housing 4*h* has a pair of projecting portions 431, 431 on both sides thereof. The pair of projecting portions 431, 431 protrude in opposite directions and are guided by the grooves 22*d*, 22*d* of the first side walls 22*a*, 22*b* on the base housing 2*h*. As the pair of first side walls 22*a*, 22*b* slidably support the two sides of the socket housing 4*h*, only a back-and-forth movement is allowed for the socket connector 4.

Configuration of First Contact

With reference to FIG. 21 or 22, the first contact 21 is composed of a bellows contact that has conductivity, which is a plurality of conductive members in a desired shape obtained by punching or folding a conductive metal plate. In consideration of ease of fabrication, spring characteristics, conductivity and the like, a copper alloy, for example, is preferably used for the first contact 21; however, the present invention is not limited thereto.

With reference to FIG. 22 or 24, the first contact 21 is composed of an extremity portion 21*a* as an elastic arm, an intermediate portion 21*b* as a fixed arm, and a base end portion 21*c* as a lead terminal. In the intermediate portion 21*b*, the conductive members extend linearly and the intermediate portion 21*b* is pressed into the groove portion 23*d* of the first contact array base 23 (see FIG. 22). The base end portion 21*c* protrudes to the outside of the second side wall 22*c*. The base end portion 21*c* is a lead terminal that is inserted into a through hole sh provided on the printed circuit board 2*p*, and soldered (see FIG. 20).

With reference to FIG. 22 or 24, the extremity portion 21*a*, in which the conductive member is bent upward at an obtuse angle, extends to an extremity side of the intermediate portion 21*b*. The extremity portion 21*a* protrudes from the bottom wall of the concave portion 22 (see FIG. 21). In addition, the extremity portion 21*a* of the first contact 21 can be in contact with the second contact 42 arrayed in the second contact array base 41 (see FIG. 24).

Configuration of Reinforcing Tab

With reference to FIGS. 20 to 22, the base connector 2 further includes, as a metallic tab, a pair of reinforcing tabs 24, 24 and a pair of reinforcing tabs 25*a*, 25*b* with guide springs. The reinforcing tabs 24 are composed of metallic plates that are bent in a crank shape. A first end of the reinforcing tabs 24 is pressed into the base housing 2*h*, while a second end thereof is inserted into a through hole provided on the printed circuit board 2*p* and soldered. The base connector 2 is thus fixed onto the printed circuit board 2*p*.

The pair of reinforcing tabs 25*a*, 25*b* with guide springs are also metallic plates for fixing the base connector 2 onto the printed circuit board 2*p*, as the reinforcing tabs 24. By directing the pair of guide springs 251, 251 toward the extremity portions of the pair of first side walls 22*a*, 22*b*, the reinforcing tabs 25*a*, 25*b* can be in contact with the pair of conductive members 45*a*, 45*b*.

Configuration of Socket Connector

With reference to FIGS. 20 to 22, the socket connector 4 includes the plate-like socket housing 4*h* and the second contact 42 in the form of eight flat springs. The second contact array base 41 is disposed in a central portion of the socket housing 4*h*. The second contact 42 is arrayed in the second contact array base 41. In addition, in the socket housing 4*h*, connecting portions 43, 43 are provided on both side portions of the second contact array base 41. In addition, the second contact array base 41 faces the first contact array base 23 so as to overlap the first contact array base 23 (see FIG. 22).

Configuration of Socket Housing

With reference to FIG. 21 or 22, a socket housing 4*h* is formed of a synthetic resin having insulation properties. On an upper face of the socket housing 4*h*, a groove portion 42*d* having eight grooves in comb-teeth form is provided (see FIG. 22). The second contact 42 is pressed into the groove 42*d* (see FIG. 22).

With reference to FIGS. 20 to 22, the connecting portions 43 are disposed on both side portions of the socket housing 4*h*. In addition, both side faces of the connecting portions 43 are guided by inner walls of the pair of first side walls 22*a*, 22*b* of the base connector 2. Furthermore, a first end of each of a plurality of link plates 5*a*, 5*b*, 5*c* and 5*d* constituting the parallel crank mechanism pcm is rotatably connected to the connecting portions 43. The plurality of link plates 5*a*, 5*b*, 5*c* and 5*d* are composed of a first pair of link plates 5*a*, 5*b* and a second pair of link plates 5*c*, 5*d*.

Configuration of Parallel Crank Mechanism

With reference to FIGS. 20 to 22, the parallel crank mechanism pcm is composed of the connecting portion 43, the upper housing 6, and the link plates 5*a*, 5*b*, 5*c*, 5*d* in a linked configuration. Pivot pins 5*p* are pressed into both side faces of the connecting portion 43, allowing the first end of each of the plurality of link plates 5*a*, 5*b*, 5*c* and 5*d* to be rotatably connected. Meanwhile, the pivot pins 5*p* are pressed into both side faces of the upper housing 6, allowing the second ends of the plurality of link plates 5*a*, 5*b*, 5*c* and 5*d* to be rotatably connected. It should be noted that the upper housing 5 of the first embodiment and the upper housing 6 of the second embodiment are the same, but are distinguished by changing reference symbols for clarity of description.

Since the connecting portion 43 and the upper housing 6 are connected with each other by means of the parallel crank mechanism pcm, the upper housing 6 is always maintained parallel with respect to the base portion 43. As shown in FIG. 23 or FIG. 24, in the lowered state in which the upper housing 6 is laid toward the front side of the connecting portion 43, the socket connector 4 can be either housed in the casing f2 (see FIG. 23) or pulled out from the casing f2 (see FIG. 24).

On the other hand, as shown in FIG. 25, in the raised state in which the upper housing 6 is pulled out from the opening k2 and raised outside the casing f2, the plug 91 can be inserted between the connecting portion 43 and the upper housing 6, allowing electrical connection of the plug 91 to the jack 20 (see FIG. 26).

With reference to FIG. 22, the first pair of link plates 5*a*, 5*b* among the plurality of link plates 5*a*, 5*b*, 5*c*, 5*d*, are provided with a pair of opposing guide pawls 51. The guide pawls 51, 51 can guide a pair of side faces 913, 913 of the plug housing 91*h* (see FIG. 6). The plug 91 can thus properly connect to the jack 20, under the control of the pair of guide pawls 51, 51.

Configuration of Second Contact

With reference to FIGS. 20 to 22, the second contact 42 is composed of a bellows contact that has conductivity. In the second contact 42, a main body, in which a plurality of conductive members extend linearly, is arrayed in the second contact array base 41. The extremity portion 21*a* of the first contact 21 is in contact with a reverse face side of the main body of the second contact 42 (see FIG. 24 or 25).

In the extremity portion of the second contact 42, the bent portion 42*a* in which the conductive members are arrayed in a state of being bent in a folded-back manner is provided. The bent portion 42*a* is arrayed at an extremity of the socket housing 4*h* (see FIG. 21). When the plug 91 is inserted between the connecting portion 43 and the upper housing 6, the contact 91*c*, which is a mating-side contact, can be in contact with the bent portion 42*a* (see FIG. 6 or 26).

Configuration of Conductive Members

With reference to FIG. 22, the socket connector 4 further includes the pair of conductive members 45*a*, 45*b*. In the pair of conductive members 45*a*, 45*b*, respective base end portions thereof fit into the socket housing 4*h* and are in contact with the pair of reinforcing tabs 25*a*, 25*b*, respectively. Meanwhile, respective extremity portions 451, 451 of the pair of conductive members 45*a*, 45*b* protrude slightly from the front face of the socket housing 4*h*. If a human body touches the extremity portion 451 of the pair of conductive members 45*a*, 45*b*, an electrical charge of the human body can be released to the printed circuit board 2*p* via the reinforcing tabs 25*a*, 25*b*.

Operation of Modular Jack

Operations and effects of the jack 20 of the second embodiment are described hereinafter by explaining behavior thereof, while giving complementary descriptions on the configuration of the jack 20.

Figure 27A:
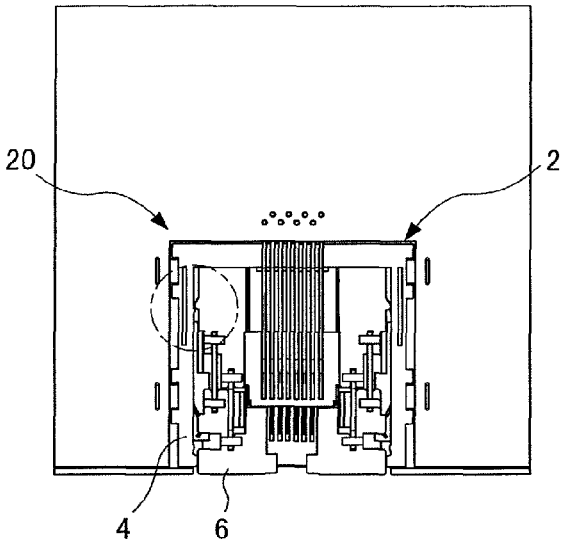
FIG. 27A is a cross-sectional view taken along a line A-A of FIG. 23 illustrating a configuration of the modular jack of the second embodiment.
Figure 27B:
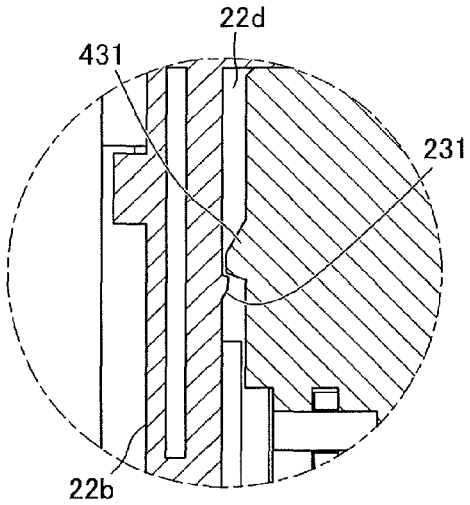
FIG. 27B is an enlarged view of a main portion of FIG. 27A.
Figure 28A:
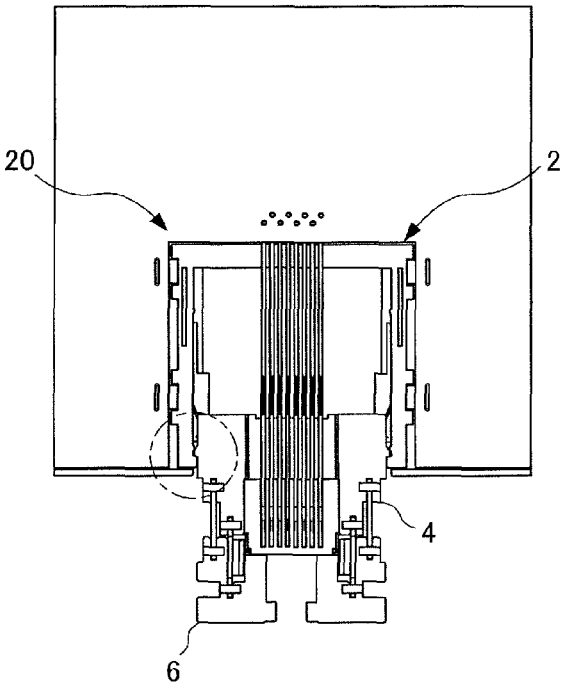
FIG. 28A is a cross-sectional view taken along a line A-A of FIG. 24 illustrating a configuration of the modular jack of the second embodiment.
Figure 28B:
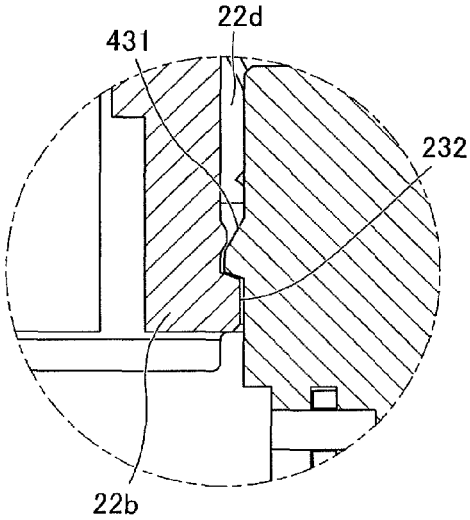
FIG. 28B is an enlarged view of a main portion of FIG. 28A.

FIG. 27A is a cross-sectional view taken along a line A-A of FIG. 23 illustrating a configuration of the modular jack of the second embodiment; and FIG. 27B is an enlarged view of a main portion of FIG. 27A. FIG. 28A is a cross-sectional view taken along a line A-A of FIG. 24; and FIG. 28B is an enlarged view of a main portion of FIG. 28A.

Figure 29:
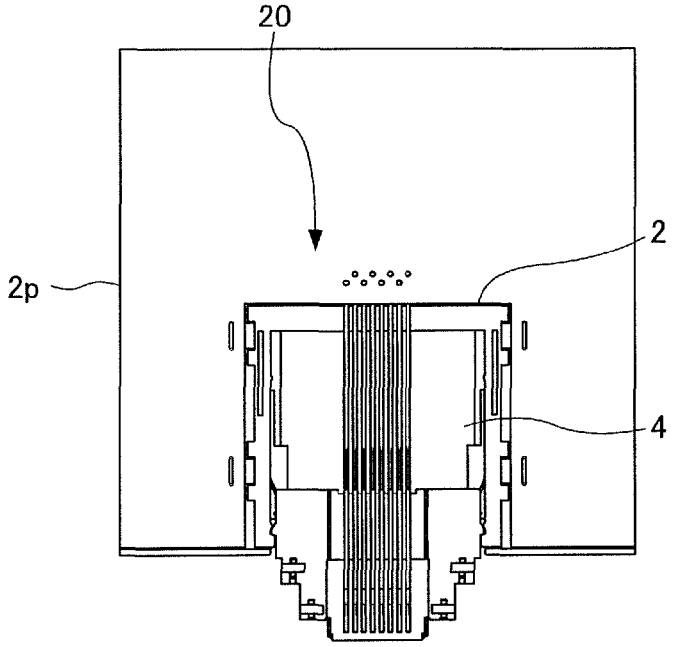
FIG. 29 is a cross-sectional view taken along a line A-A of FIG. 25 illustrating a configuration of the modular jack of the second embodiment.
Figure 30:
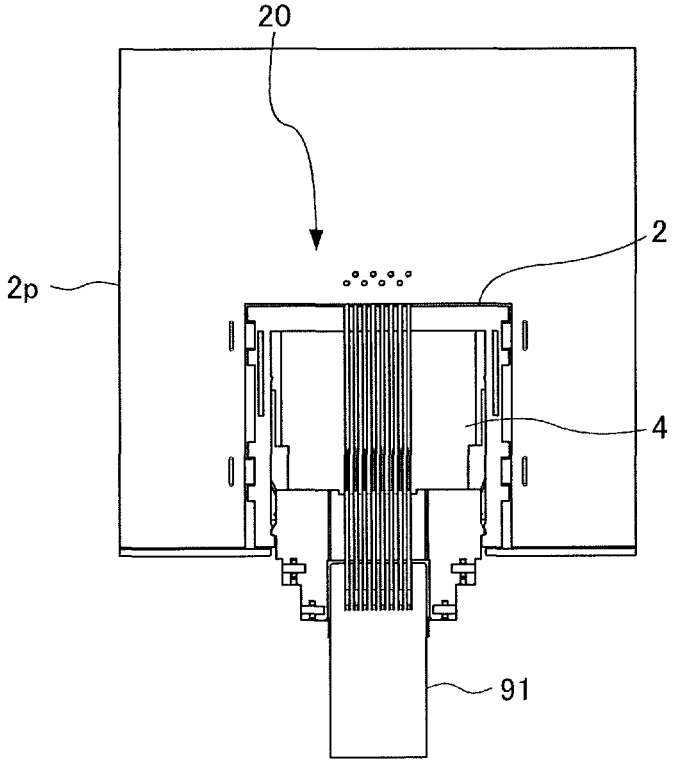
FIG. 30 is a cross-sectional view taken along a line A-A of FIG. 26 illustrating a configuration of the modular jack of the second embodiment.

FIG. 29 is a cross-sectional view taken along a line A-A of FIG. 25 illustrating a configuration of the modular jack of the second embodiment. FIG. 30 is a cross-sectional view taken along a line A-A of FIG. 26 illustrating a configuration of the modular jack of the second embodiment.

As shown in FIG. 18A or 19A, the jack 20 is usually stored inside the casing f2. The opening k2 provided on the side face of the casing f2 is shut by the front face of the upper housing 6.

In the state shown in FIG. 18A or 19A, the socket connector 4 fits into the base connector 2 (see FIG. 20 or 23). With reference to FIG. 27B, a first stop projection 231 is provided on the rear side of the groove 22*d*. As the first stop projection 231 engages with the projecting portion 431, the socket housing 4*h* is maintained in a stored state with respect to the base housing 2*h*. By pulling the socket housing 4*h* away from the base housing 2*h* with a force such that the projecting portion 431 can run over the first stop projection 231, the socket housing 4*h* can be pulled out from the base housing 2*h*.

For connecting the plug 91 to the jack 20, the socket connector 4 is first pulled out from the casing f2. In this case, since a concavity is provided on a bottom face of the upper housing 6 as shown in FIG. 24 or 25, the socket connector 4 can be easily pulled out.

FIG. 18B or FIG. 19B and FIG. 24 are diagrams illustrating a state in which the socket connector 4 is completely pulled out from the casing f2. In this case, as shown in FIG. 28B, since a second stop projection 232 is provided on an entrance side of the groove 22*d*, the projecting portion 431 engages with the second stop projection 232. As a result, the socket housing 4*h* is stably maintained in a pulled out state with respect to the base housing 2*h*. By pulling the socket housing 4*h* away from the base housing 2*h* with a force such that the projecting portion 431 can run over the second stop projection 232, the socket housing 4*h* is released from the stably maintained state. This can prevent, for example, damage to the base connector 2.

From the state shown in FIG. 18B or FIG. 19B and FIG. 24, by rotating the upper housing 6 to a first direction as shown in FIG. 18C or 19C, the upper housing 6 goes into the raised state outside the casing f2 (see FIG. 25). The plug 91 can thus be inserted between the connecting portion 43 and the upper housing 6, to be electrically connected to the jack 20 (see FIG. 18D or FIG. 19D).

In the state shown in FIG. 18D or FIG. 19D, the pair of engaging pawls 91*n*, 91*n* of the plug 91 engage with a notched groove 6*k* provided on the upper housing 6 (see FIG. 21). The plug 91 can thus be locked into the socket connector 4. In addition, in the state shown in FIG. 18D or FIG. 19D, the plug 91 and the printed circuit board 2*p* are electrically connected with each other in a sequential path of: the contact 91*c*, the second contact 42, and the first contact 21.

For disconnecting the plug 91, the plug 91 can be released and the socket connector 4 can be stored inside the casing f2 by the above described procedure in reverse order.

In the jack 20 of the second embodiment, in a state in which the upper housing 6 is laid toward the front side of the socket housing 4*h*, the socket connector 4 can be housed inside the casing f2. In other words, when the upper housing 6 is in the lowered state, the upper housing 6 and the socket housing 4*h* can be stored inside the concave portion 22 of the base housing 2*h* and the upper faces thereof are made flat. As a result, with the jack 20, a modular jack of a reduced height can be provided, to realize a reduction in size of an electronic device. In addition, the jack 20 has a further advantage of requiring a smaller area on a printed circuit board than the jack 10 of the first embodiment.

What is claimed is:

1. A modular jack to which a modular plug with a latching tab is electrically connected, the modular jack comprising a socket connector including:

a base connector provided inside a casing with an opening on a side face, an upper housing that can interlock with the latching tab, and a parallel crank mechanism that can switch the upper housing between a lowered state and a raised state, the socket connector being slidably connected to the base connector; wherein in the lowered state of the upper housing, a front face of the upper housing shuts the opening and the socket connector can be housed inside the casing, and in the raised state in which the upper housing is pulled out from the opening and raised outside of the casing, the modular plug can interlock with the upper housing via the latching tab and electrically connect to the base connector.

2. The modular jack according to claim 1, further comprising a fixing member for installing the base connector to a printed circuit board inside the casing.

3. The modular jack according to claim 2, wherein the fixing member is a metallic tab provided on a side wall of the base connector.

4. The modular jack according to claim 3, wherein the side wall of the base connector with the metallic tab is held along an edge portion of the printed circuit board.

5. The modular jack according to claim 1, wherein the base connector includes:

a plate-like base housing provided with a first contact array base positioned on a rear side with respect to the opening of the casing, and a pair of opposing guide arms extending from the first contact array base toward the opening; and a first contact formed as a plurality of flat springs, an extremity portion thereof protruding from the first contact array base between the pair of guide arms, a middle portion thereof being fixed to the first contact array base, and a base end portion thereof protruding to a side opposite to the guide arms and being joined to the printed circuit board;

and the socket connector includes:

a plate-like socket housing provided with a second contact array base that is positioned at a base end portion of the socket connector and engages with the first contact array base so as to overlap the first contact array base, and a base portion that is disposed at an extremity portion of the socket connector, both side faces thereof being guided to an inner wall of the pair of guide arms, and to which a first end of each of a plurality of link plates constituting the parallel crank mechanism is rotatably connected; and a second contact formed as a plurality of flat springs, being arrayed on the second contact array base and being in slidable contact with the extremity portion of the first contact, and having a bent portion in an extremity portion thereof that can connect to a mating-side contact.

6. The modular jack according to claim 5, wherein the plurality of link plates includes two pairs of link plates, a first pair of the two pairs of link plates having guide pawls that guide a pair of side faces of the plug housing.

7. The modular jack according to claim 5, wherein:

the pair of guide arms have opposing grooves that extend from the first contact array base to an extremity of each of the guide arms;

the socket housing has a pair of projecting portions that protrude in opposite directions and are guided by the grooves, in both end portions of the base portion; and the grooves have first stop projections that engage with the projecting portions to maintain the socket housing in a stored state with respect to the base housing, and second stop projections that engage with the projecting portions to maintain the socket housing in a pulled-out state with respect to the base housing, the first stop projections and the second stop projections protruding from a bottom face of the grooves.

8. The modular jack according to claim 1, wherein the base connector includes:

a rectangular plate-like base housing provided with a substantially rectangular concave portion surrounded by a pair of opposing first side walls and a second side wall which connects first ends of the first side walls, and a first contact array base formed on a bottom wall of the concave portion; and a first contact formed as a plurality of flat springs, an extremity portion thereof protruding from the bottom wall of the concave portion, a middle portion thereof being fixed to the first contact array base, and a base end portion thereof protruding to the outside of the second side wall of the base housing and being joined to the printed circuit board, and the socket connector includes:

a plate-like socket housing provided with a second contact array base that is positioned at a central portion of the socket connector and faces the first contact array base so as to overlap the first contact array base, and a connection portion to which a first end of each of a plurality of link plates constituting the parallel crank mechanism is rotatably connected, the socket housing being disposed to be housed inside the concave portion of the base housing while both side faces thereof are guided by inner walls of the first side walls; and a second contact formed as a plurality of flat springs, being arrayed on the second contact array base and being in contact with the extremity portion of the first contact, and having a bent portion in an extremity portion thereof that can connect to a mating-side contact.

9. The modular jack according to claim 8, wherein the plurality of link plates includes two pairs of link plates, a first pair of the two pairs of link plates having guide pawls that guide a pair of side faces of the plug housing.

10. The modular jack according to claim 8, wherein the pair of first side walls have opposing grooves that extend from the second side wall to extremities of the first side walls;

the socket housing has a pair of projecting portions that protrude in opposite directions and are guided by the grooves, in both side portions of the socket housing; and the grooves have first stop projections that engage with the projecting portions to maintain the socket housing in a stored state with respect to the base housing, and second stop projections that engage with the projecting portions to maintain the socket housing in a pulled-out state with respect to the base housing, the first stop projections and the second stop projections protruding from a bottom face of the grooves.

* * * * *